US007320955B2

(12) United States Patent
Yates et al.

(10) Patent No.: US 7,320,955 B2
(45) Date of Patent: Jan. 22, 2008

(54) COMPOSITIONS COMPRISING COMPLEXES OF CYCLODEXTRIN AND AT LEAST ONE LAUNDRY TREATMENT ACTIVE

(75) Inventors: Adam Thomas Yates, Northumbria (GB); Alan Thomas Brooker, Newcastle Upon Tyne (GB); Sylvestre Canceil, Newcastle upon tyne (GB); Jean-Luc Bettiol, Brussels (BE); Andrew Russell Graydon, Tyne & Wear (GB); Paul Lapham, North Shields (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/348,152

(22) Filed: Feb. 6, 2006

(65) Prior Publication Data

US 2006/0128594 A1 Jun. 15, 2006

Related U.S. Application Data

(63) Continuation of application No. 10/794,366, filed on Mar. 5, 2004, now abandoned.

(30) Foreign Application Priority Data

Mar. 24, 2003 (EP) ..... 03447059
Jan. 12, 2004 (EP) ..... 04447006

(51) Int. Cl.
*C11D 17/08* (2006.01)

(52) U.S. Cl. ..... 510/411; 510/470; 510/515

(58) Field of Classification Search ..... 510/411, 510/470, 515
See application file for complete search history.

(56) References Cited

U.S. PATENT DOCUMENTS 4,808,189 A * 2/1989 Oishi et al. ..... 8/408
5,139,687 A * 8/1992 Borgher et al. ..... 510/515
6,133,215 A 10/2000 Zelger et al.
6,284,231 B1 9/2001 Trinh et al.
6,287,603 B1 * 9/2001 Prasad et al. ..... 424/489
6,407,079 B1 6/2002 Muller et al.
6,432,928 B1 8/2002 Szente et al.
6,602,860 B1 * 8/2003 Pitha ..... 514/58
2003/0236457 A1 * 12/2003 Mericle et al. ..... 600/420
2004/0005994 A1 1/2004 Eskuchen et al.
2005/0281741 A1 * 12/2005 Achilefu et al. ..... 424/1.69

FOREIGN PATENT DOCUMENTS

DE 3 020 269 1/1981
DE 41 40 830 A1 6/1992
EP 1 084 625 A2 3/2001
WO WO 01/88076 A1 11/2001

* cited by examiner

*Primary Examiner*—John R. Hardee
(74) *Attorney, Agent, or Firm*—Ronald Terk Sia; David V. Upite; Kim William Zerby

(57) ABSTRACT

The present invention relates to compositions comprising (A) a complex of cyclodextrin and at least one laundry treatment active wherein the complex is prepared by the steps of:
  (a) combining cyclodextrin and at least one laundry treatment active wherein the cyclodextrin and the laundry treatment active is dissolved, dispersed, suspended, or emulsified in at least one solvent; and
  (b) removing at least partially the solvent;

(B) further comprising at least one laundry adjunct material selected from the group consisting of surfactants; stabilizers; builders; perfumes; enzymes; chelating agents; suds suppressors; colors; opacifiers; anti-oxidants; bactericides; neutralizing agents; buffering agents; phase regulants, dye-transfer inhibitors, hydrotropes, thickeners and mixtures thereof.

The present invention is further directed to the process of preparing such compositions and to methods of treating substrates with such compositions.

21 Claims, No Drawings

COMPOSITIONS COMPRISING COMPLEXES OF CYCLODEXTRIN AND AT LEAST ONE LAUNDRY TREATMENT ACTIVE

CROSS REFERENCE TO RELATED APPLICATIONS

This application is a continuation of U.S. patent application Ser. No. 10/794,366, filed Mar. 5, 2004, now abandonded the disclosure of which is incorporated by references.

FIELD OF THE INVENTION

This invention relates to compositions comprising complexes of cyclodextrin and at least one laundry treatment active. The compositions further comprise at least one additional laundry adjunct material. The complexes are prepared by the steps of combining cyclodextrin and at least one laundry treatment active in the presence of at least one solvent, followed by at least partial removal of the solvent. The invention further relates to methods of treating substrates with such compositions.

BACKGROUND TO THE INVENTION

Modern laundry compositions either for use in domestic or industrial care comprise a number of ingredients, sometimes more than 30 different actives. For most of these ingredients, it is essential that they dissolve quickly and completely in the wash liquor to deliver optimum performance. It is known in the art that the dissolution profile of each ingredient depends on certain conditions, e.g., nature of the ingredient, the temperature in the wash liquor, and the degree of hardness of the wash liquor, to name just a few. It is particularly true, that dependent on the hardness of the wash liquor the solubility of many laundry detergent ingredients is influenced in such a way that the higher the hardness of the wash liquor, the lower is the solubility of many laundry detergent ingredients and hence the lower is the performance of a given laundry detergent composition.

One way to overcome this disadvantage of low performance is to overdose. However, due to higher costs for the consumer and due to the environmental impact of overdosing, the detergent industry is seeking for different solutions. One better way is the use of specific water treatment compositions comprising chelating agents to complex free calcium ions, which are basically responsible of the hardness of water. This approach has a number of drawbacks: one being the additional costs for the consumer, another one being the inconvenience for the consumer to add another composition in the drawer of the washing machine. The main problem associated with this approach to overcome this disadvantage however is the fact that the hardness of the wash water varies from location to location and even changes over time so that the consumer is not always aware of the actual water hardness in his neighborhood at the time he wants to run a laundry cycle.

The present invention overcomes this problem and provides compositions with improved dissolution profile, particularly when fast dissolution is critical to get the optimum performance of actives under hard water conditions.

The present invention utilizes cyclodextrin as carrier for laundry treatment actives. It has been found that a complex of cyclodextrin and at least one laundry treatment active is more soluble in water and provides better solubility than the laundry treatment active alone.

The use of cyclodextrin is known in the art as an efficient carrier for cosmetics and drugs. U.S. Pat. No. 6,407,079 (Janssen Pharmaceutica, published Jun. 18, 2002) discloses pharmaceutical compositions comprising inclusion compounds of sparingly water-soluble or water-insoluble drugs with beta-cyclodextrin ethers or beta-cyclodextrin esters. U.S. Pat. No. 6,432,928 (Chinoin Gygyszer, published Aug. 13, 2002) provides inclusion complexes of cyclodextrin derivatives with taxol and its derivatives for use in the pharmaceutical industry.

Cyclodextrin is also known in the art as a malodor control agent able to capture malodorous molecules in its cavity. U.S. Pat. No. 6,284,231 (P&G, published Sep. 04, 2001) discloses stable, aqueous odor-absorbing compositions, comprising uncomplexed cyclodextrin entities.

Cyclodextrin has also been used to carry hydrophobic and therefore relatively water-insoluble perfumes into hydrophilic environments. U.S. Pat. No. 6,287,603 (Nestec, published Sep. 11, 2001) discloses a cyclodextrin flavor delivery system comprising inclusion complexes of cyclodextrin and perfumes.

U.S. Pat. No. 6,133,215 (CIBA, published Oct. 17, 2000) discloses a white crystal form of a fabric brightener which is obtained when adding a polyol, such a glycerine, ethylene glycol and/or other polyols, to a solution of a fabric brightener in water or ethanol. Cyclodextrin is disclosed as an absorbent filler/carrier and added as solid material during the process.

It has been found that the process of U.S. Pat. No. 6,133,215 has some drawbacks including agglomeration and caking of cyclodextrin when adding it into the reaction vessel. The material obtained by the processes of U.S. Pat. No. 6,133,215 is not suitable for incorporation into the detergent compositions of the present invention. The present invention therefore suggests compositions comprising complexes of cyclodextrin and at least one laundry treatment active, prepared by following certain steps. Complexes prepared in such a way are suitable for incorporation into the detergent compositions of the present invention.

SUMMARY OF THE INVENTION

The present invention relates to compositions comprising (A) a complex of cyclodextrin and at least one laundry treatment active wherein the complex is prepared by the steps of:

(a) combining cyclodextrin and at least one laundry treatment active wherein the cyclodextrin and the laundry treatment active is dissolved, dispersed, suspended, or emulsified in at least one solvent; and (b) removing at least partially the solvent;

(B) further comprising at least one laundry adjunct material selected from the group consisting of surfactants; stabilizers; builders; perfumes; enzymes; chelating agents; suds suppressors; colours; opacifiers; anti-oxidants; bactericides; neutralizing agents; buffering agents; phase regulants, dye-transfer inhibitors, hydrotropes, thickeners and mixtures thereof.

The present invention is further directed to the process of preparing such compositions and to methods of treating substrates with such compositions.

DETAILED DESCRIPTION OF THE INVENTION

1, Preparation of the Complex

The preparation of the complexes of the present invention comprise two essential steps. The first step is the combination of cyclodextrin and at least one laundry treatment active in the presence of at least one solvent. The second step is the at least partial removal of the solvent. For carrying out the preparation of the complexes, three components are needed: the first one is cyclodextrin, the second one is at least one laundry treatment active, and the third one is at least one solvent. It is believed that the cyclodextrin and the fabric treatment active form a complex with each other.

In general, the molar ratio of the cyclodextrin and the laundry treatment active can be any suitable ratio. In a preferred embodiment of the present invention, the molar ratio between the cyclodextrin and the laundry treatment active is between 100:1 and 1:100, preferably between 10:1 and 1:10, more preferably between 5:1 and 1:5, and most preferably between 2:1 and 1:2. The final molar ratio depends on the molecular size of the laundry treatment active(s) and the size of the cyclodextrin cavity. Although the normal complex is one molecule of laundry treatment active in one molecule of cyclodextrin, complexes can be formed between more than one laundry treatment active and one molecule of cyclodextrin when the laundry treatment active is rather small and/or the cavity of the cyclodextrin is rather large. Furthermore, complexes can be formed between more than one cyclodextrin and one molecule of laundry treatment active when the laundry treatment active is rather large and the cavity of the cyclodextrin is rather small or when the laundry treatment active contains more than one portion that can form a complex with more than one cyclodextrin. For example, it has been found and confirmed by computer assisted molecular modeling that the most stable complexes comprising respectively two mols of TAED (an bleach activator) for one mol of beta-cyclodextrin and one mol of NOBS (a bleach precursor) for one mol of beta-cyclodextrin are formed by the preparation of the present invention. Note that in these particular research the complexes are formed in water.

Another example is the formation of a complex comprising beta-cyclodextrin and a brightener (Tinopal® CDX from Ciba Geigy). The end result obtained confirmed that the predicted most stable complexes comprising respectively one mol of Tinopal® CDX for one mol of beta-cyclodextrin. Note that in this particular research the complex is formed in water.

The preparation of the complexes can be carried out in any of the ways as follows. In general, the preparation has to be carried out in such a way that a complex between the cyclodextrin and the laundry treatment active is formed. Typically, one can distinguish between a complex formed by only two components, i.e. cyclodextrin and bleaching agent, cyclodextrin and brightener, cyclodextrin and fabric softening agent, and a complex formed by cyclodextrin and a mixture of more than one laundry treatment active, e.g. cyclodextrin and bleaching agent and brightener, or cyclodextrin and a brightener and a fabric softening agent. For the preparation of the complexes, it is required that both the cyclodextrin and the laundry treatment active are dissolved, dispersed, suspended or emulsified in at least one solvent to which the other component or components are then added as well dissolved, dispersed, suspended or emulsified in at least one solvent.

The next step in the preparation of the complexes is to remove at least partially the solvent. This step can be carried out as known in the art, such as evaporating the solvent by applying heat, preferably applying heat in such a way that no decomposition of neither the formed complex, its components nor the solvent occurs. A second method to evaporate the solvent is to work under reduced pressure so that the solvent can be removed without applying heat at all or a combination of both methods if suitable. The end product of such a preparation may be a solution, an emulsion, a dispersion, or a slurry depending on the amount of solvent left and depending on the dissolution profiles of the ingredients. In case that the solvent is completely removed, a solid material comprising cyclodextrin and at least one laundry treatment active is obtained.

It is desirable to work with minimal amount of solvent and with the fewest possible steps to avoid excessive costs.

One of the most reliable methods for the preparation of solid complexes with cyclodextrins is to isolate them from the saturated aqueous solution. Amounts of host and guest to be mixed in water are estimated. The components are added to water and shaken/stirred until solubility equilibrium is reached, or preferably they are dissolved in hot water and cooled down slowly. As the result, the complex precipitates as a microcrystalline powder, and is separated out by filtration and dried.

However, this method is not applicable to the systems when the resulting complex is more soluble than its components. This method is also not applicable because of the use of large amounts of water and because this method is time-consuming.

Other methods such as kneading, freeze-drying, spray-drying, co-precipitation, neutralization and grinding methods that are know and used by skilled people.

The kneading approach is where the guest compound is added to a slurry of cyclodextrin and kneaded thoroughly to obtain a paste which is then dried. The solid obtained is washed with a small amount of solvent such as ether or ethanol to remove the adsorbed free guest component from the complex. This method is particularly useful for poorly water-soluble guests, since the guest dissolves slowly with the formation of such complexes.

In the case of the co-precipitation method, the watch-out is the organic solvents used as the precipitant which may competitively inhibit the complex formation (pyridine is particularly aggressive).

Freeze-drying & spray-drying methods are suitable for water-soluble guests, since cyclodextrins and guests should be dissolved in water before drying.

Solid compounds with the guest having acidic or basic functional groups can sometimes be obtained by the neutralisation method. In this method the guest is first dissolved as a salt in alkaline or acidic solutions containing cyclodextrins, and the solution is then neutralised. However this method is not suitable for chemically unstable guests in acidic or alkaline conditions and it should be remembered that cyclodextrins are readily hydroylsed in the linear oligosacchardides in strong acidic conditions.

If the guests are susceptible to hydrolysis grinding method is to be used preferentially because of the absence of water.

Finally the compound prepared should always be analysed for its composition (guest/host/water content) because the stoichiometry sometimes varies depending on the conditions. The formation of the complex could be confirmed by using powder X-ray/X-ray diffraction of the complex versus separate Host guest material.

Suitable processes are disclosed in the following art: J. L. Atwood, J. E. D. Davies & D. D. Mac Nichol (Editors): Inclusion Compounds, Vol. III, Academic Press 1984, especially chapter 11; J. L. Atwood and J. E. D. Davies (Editors): Proceedings of the Second International Symposium of Cyclodextrins, Tokyo, Japan, July 1984; Cyclodextrin Technology, J. Szejtli, Kluwer Academic Publishers, 1988.

When all of the solvent is removed, a solid material in obtained typically having a weight mean particle size generally from 50 μm to 2000 μm, preferably being at least 300 μm and not above 1700 μm, preferably below 1600 μm. This weight mean particle size can for example be determined by sieve analysis, for example by sieving a sample of the particulate relevant material herein through a series of sieves, typically 5, with meshes of various diameter or aperture size, obtaining a number of fraction (thus having a particle size of above, below or between the mesh size of the used sieve size).

The density of the solid material is generally above 300 g/l, preferably greater than 400 g/l or even greater than 500 g/l. The density of the solid according to the invention is generally below 1500 g/l, preferably below 1100 g/l.

2, Cyclodextrin

As used herein, the term "cyclodextrin" includes any of the known cyclodextrins such as unsubstituted and substituted cyclodextrins containing from six to twelve glucose units, especially, alpha-cyclodextrin, beta-cyclodextrin, gamma-cyclodextrin, or mixtures thereof. The alpha-cyclodextrin consists of six glucose units, the beta-cyclodextrin consists of seven glucose units, and the gamma-cyclodextrin consists of eight glucose units arranged in donut-shaped rings. The specific coupling and conformation of the glucose units give the cyclodextrins a rigid, conical molecular structure with hollow interiors of specific volumes. The "lining" of each internal cavity is formed by hydrogen atoms and glycosidic bridging oxygen atoms; therefore, this surface is fairly hydrophobic. The unique shape and physical-chemical properties of the cavity enable the cyclodextrin molecules, and derivatives thereof, to absorb (form inclusion complexes with) organic molecules or parts of organic molecules which can fit into the cavity. Many organic molecules fit into the cavity, including the laundry treatment actives of the present invention. Therefore, cyclodextrins and their derivatives, and especially mixtures of cyclodextrins with different size cavities, can be used to complex the specific laundry treatment actives of the present invention. The complexation between cyclodextrin and the laundry treatment active occurs particularly rapidly in the presence of at least one solvent, in which at least one or preferably both components, the cyclodextrin and/or the laundry treatment active, are at least partially, if not completely soluble. Alternatively, when the laundry treatment active is potentially hydrolysed in the presence of water, the cyclodextrin and the laundry treatment active are grinded together in order to form the complex. The grinding method is well known in the art and occasionally used to form complexes between two or more components when at least one of the components can be treated with a specific solvent, e.g. water.

Derivatives of cyclodextrins consist mainly of molecules wherein some or even all of the OH groups are converted to OR groups. Typically, one glucose unit contains more than one OH group, e.g., three OH groups. Thus, considering alpha-cyclodextrin containing six glucose units, from 1 to 18 of such OH groups can be converted to OR groups. Accordingly, for beta-cyclodextrin, this conversion can take place up to 21 times and for gamma-cyclodextrin up to 24 times. In cyclodextrin derivatives the R group can be selected from neutral and uncharged groups, e.g., alkyl, alkenyl, aryl, alkylaryl, arylalkyl, ester, ether and mixtures thereof. Furthermore, cationically or anionically charged R groups are included in this definition of cyclodextrins as well, e.g. moieties comprising ammonium groups having a positive charge or e.g., moieties comprising sulfate, sulfite, and/or carboxylate groups all having a negative charge. Typical cyclodextrin derivatives include, e.g., those with short chain alkyl groups such as methylated cyclodextrins, ethylated cyclodextrins, wherein R is a methyl or an ethyl group; those with hydroxyalkyl substituted groups, such as hydroxypropyl cyclodextrins and/or hydroxyethyl cyclodextrins, wherein R is a $—CH_2—CH(OH)—CH_3$ or a $^-CH_2CH_2—OH$ group; branched cyclodextrins such as maltose-bonded cyclodextrins; cationic cyclodextrins such as those containing 2-hydroxy-3-(dimethylamino)propyl ether, wherein R is $CH_2—CH(OH)—CH_2—N(CH_3)_2$ which is cationic at low pH; quaternary ammonium, e.g., 2-hydroxy-3-(trimethylammonio)propyl ether chloride groups, wherein R is $CH_2—CH(OH)—CH_2—N^+(CH_3)_3Cl^-$; anionic cyclodextrins such as carboxymethyl cyclodextrins, cyclodextrin sulfates, and cyclodextrin succinylates; amphoteric cyclodextrins such as carboxymethyl/quaternary ammonium cyclodextrins; cyclodextrins wherein at least one glucopyranose unit has a 3-6-anhydro-cyclomalto structure, e.g., the mono-3-6-anhydrocyclodextrins, as disclosed in "Optimal Performances with Minimal Chemical Modification of Cyclodextrins", F. Diedaini-Pilard and B. Perly, The 7th International Cyclodextrin Symposium Abstracts, April 1994, p. 49. Other cyclodextrin derivatives are disclosed in U.S. Pat. No. 3,426,011 (Parmerter et al., published Feb. 4, 1969), U.S. Pat. Nos. 3,453,257; 3,453,258; 3,453,259; and 3,453,260 (all in the names of Parmerter et al., and all published Jul. 1, 1969); U.S. Pat. No. 3,459,731 (Gramera et al., published Aug. 5, 1969). Further cyclodextrin derivatives suitable herein include those disclosed in V. T. D'Souza and K. B. Lipkowitz, CHEMICAL REVIEWS: CYCLODEXTRINS, Vol. 98, No. 5 (American Chemical Society, July/August 1998). Examples of preferred water-soluble cyclodextrin derivatives suitable for use herein include hydroxypropyl alpha-cyclodextrin, methylated alpha-cyclodextrin, methylated beta-cyclodextrin, hydroxyethyl beta-cyclodextrin, hydroxypropyl beta-cyclodextrin, hydroxypropyl gamma-cyclodextrin, and methylated gamma-cyclodextrin.

It is understood that commercially available cyclodextrin derivatives contain individual cyclodextrin molecules having varying degrees of substitution. For example, hydroxypropyl beta-cyclodextrin having an average degree of substitution of 3 still contains an amount of non-derivatized beta-cyclodextrin of about 5%, while hydroxypropyl beta-cyclodextrin having an average degree of substitution of about 5 has an amount of non-derivatized beta-cyclodextrin of less than about 1%. These facts are acknowledged with the term "degree of substitution". The term "average degree of substitution" thus relates to the average statistical distribution of individual substituted cyclodextrin molecules of a given cyclodextrin derivative. The term "low-degree of substitution" refers to cyclodextrin derivatives in which less than about one-fourth (¼) of the OH groups of the cyclodextrin molecule have been converted to OR groups.

For the preparation of the complexes and of the compositions of the present invention, a mixture of cyclodextrins and derivatives thereof can be used such that the mixture effectively comprises cyclodextrins and derivatives thereof with different cavity sizes, with different degrees of substitution and different degrees of hydrophility. Preferably at least a portion of a cyclodextrin mixture is alpha-cyclodextrin and its derivatives thereof, gamma-cyclodextrin and its derivatives thereof, and/or beta-cyclodextrin and its derivatives thereof; more preferably a mixture of alpha-cyclodextrin, or an alpha-cyclodextrin derivative, and derivatized beta-cyclodextrin, even more preferably a mixture of derivatised alpha-cyclodextrin and derivatized beta-cyclodextrin; and most preferably a mixture of hydroxypropyl alpha-cyclodextrin and hydroxypropyl beta-cyclodextrin, and/or a mixture of methylated alpha-cyclodextrin and methylated beta-cyclodextrin.

3, Laundry Treatment Active

A laundry treatment active is the second essential component for the preparation of the complexes of the present invention. The laundry treatment active of the present invention is preferably selected from the group consisting of bleaching agents, brighteners, fabric softening agents, and mixtures thereof. In general, any bleaching agent, any brightener, any fabric softening agent, and any mixture thereof can be used in the preparation of the complexes and compositions of the present invention. However, certain actives are more preferred as follows:

3,1 Bleaching Agent

The bleaching agent can be independently selected from a number of different actives as disclosed below:

In one preferred embodiment herein, the bleaching agent comprises a source of oxygen and/or is an oxygen-releasing bleaching agent. This oxygen-releasing bleaching agent contains a hydrogen peroxide source.

When the bleaching active is an organic peroxyacid bleach precursor compound the production of the organic peroxyacid occurs by an in situ reaction of the precursor with a source of hydrogen peroxide. In an alternative preferred aspect a preformed organic peroxyacid is incorporated directly into the composition.

When the bleaching active is a preformed peracid, or a bleach catalyst the mixed compositions may be used or used not together with a source of hydrogen peroxide.

The preferred sources of hydrogen peroxide include inorganic perhydrate bleaches. Compositions containing mixtures of a hydrogen peroxide source and organic peroxyacid precursor in combination with a preformed organic peroxyacid are also envisaged.

The compositions comprising the complexes prepared by the steps of the present invention preferably include a hydrogen peroxide source, as an oxygen-releasing bleach. Suitable hydrogen peroxide sources include the inorganic perhydrate salts.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in a granular product prepared by the steps of the present invention.

Sodium perborate can be in the form of the monohydrate of nominal formula $NaBO_2.H_2O_2$ or the tetrahydrate $NaBO_2H_2O_24H_2O$.

Alkali metal percarbonates, particularly sodium percarbonate, are preferred perhydrates for incorporation in compositions in accordance with the invention. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise. The percarbonate is most preferably incorporated into such compositions in a coated form which provides in-product stability.

A suitable coating material providing in product stability comprises mixed salt of a water soluble alkali metal sulphate and carbonate. Such coatings together with coating processes have previously been described in GB-1,466,799, granted to Interox on 9th Mar. 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n, Na_2CO_3$ wherein n is from 0.1 to 3, preferably n is from 0.3 to 1.0 and most preferably n is from 0.2 to 0.5.

Another suitable coating material providing in product stability, comprises sodium silicate of $SiO_2$: $Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating. Coatings that contain silicate and borate salts or boric acids or other inorganics are also suitable.

Other coatings which contain waxes, oils, fatty soaps can also be used advantageously within the present invention.

Potassium peroxymonopersulfate is another inorganic perhydrate salt of utility in the compositions herein.

Other Suitable Source of Bleach

Other suitable bleaches are hypohalites provided by a variety of sources, including bleaches that lead to the formation of positive halide ions and/or hypohalite ions, as well as bleaches that are organic based sources of halides, such as chloroisocyanurates.

Suitable hypohalite bleaches for use herein include the alkali metal and alkaline earth metal hypochlorites, hypobromites, hypoiodites, chlorinated trisodium phosphate dodecahydrates, potassium and sodium dichloroisocyanurates, potassium and sodium trichlorocyanurates, N-chloroimides, N-chloroamides, N-chloroamines and chlorohydantoins.

In a preferred embodiment wherein the bleaching compositions are liquid, the hypohalite bleach is an alkali metal and/or alkaline earth metal hypochlorite. More preferably, for liquid bleaching compositions the hypohalite bleach is an alkali metal and/or alkaline earth metal hypochlorite selected from the group consisting of sodium hypochlorite, potassium hypochlorite, magnesium hypochlorite, lithium hypochlorite and calcium hypochlorite, and mixtures thereof. Even more preferably, for liquid bleaching compositions the hypohalite bleach is sodium hypochlorite.

In another preferred embodiment wherein the bleaching compositions are solid, the hypohalite bleach is: an alkali metal or alkaline earth metal hypochlorite; chlorinated trisodium phosphate dodecahydrate; potassium dichloroisocyanurate; sodium dichloroisocyanurate; potassium trichlorocyanurate; sodium trichlorocyanurate; or a mixture thereof. More preferably, for solid bleaching compositions the hypohalite bleach is: an alkali metal or alkaline earth metal hypochlorite selected from the group consisting of lithium hypochlorite and calcium hypochlorite; chlorinated trisodium phosphate dodecahydrate; potassium dichloroisocyanurate; sodium dichloroisocyanurate; potassium trichlorocyanurate; sodium trichlorocyanurate; or a mixture thereof. Even more preferably, for solid bleaching compositions the hypohalite bleach is sodium dichloroisocyanurate and/or calcium hypochlorite.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

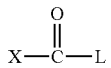

where L is a leaving group and X is essentially any functionality, such that on perhydrolysis the structure of the peroxyacid produced is

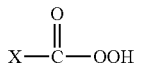

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching composition.

Preferred L groups are selected from the group consisting of:

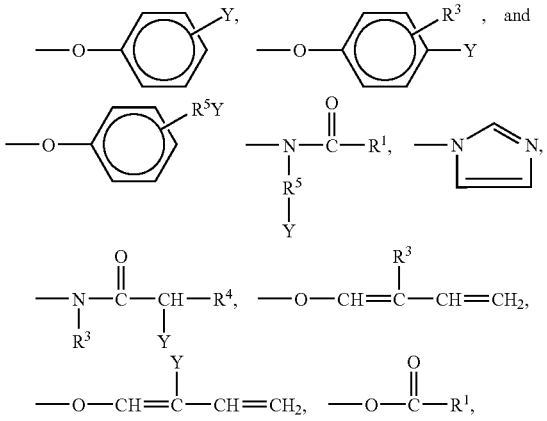

-continued

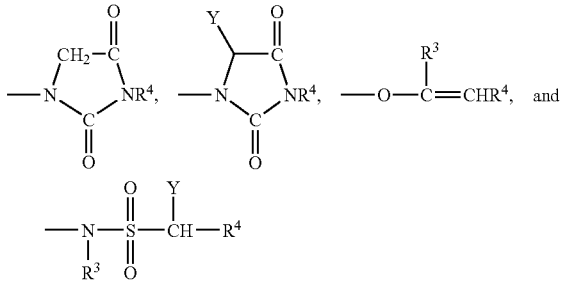

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, $R^5$ is an alkenyl chain containing from 1 to 8 carbon atoms and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R_3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

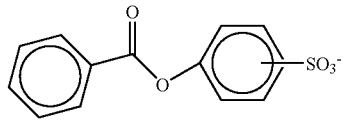

Also suitable are the benzoylation products of sorbitol, glucose, and all saccharides with benzoylating agents, including for example:

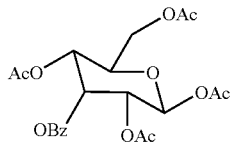

Ac=COCH3; Bz=Benzoyl

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

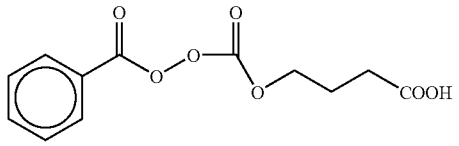

Phthalic anhydride is another suitable perbenzoic acid precursor compound herein:

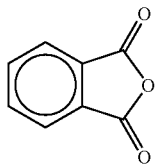

Suitable N-acylated lactam perbenzoic acid precursors have the formula:

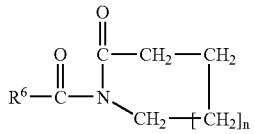

wherein n is from 0 to 8, preferably from 0 to 2, and $R^6$ is a benzoyl group.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e.; non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

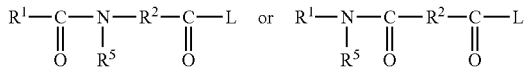

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Other preferred peracid precursors are the ones described in EP 0 166 571, assigned to P&G. In cited patent, peracid compounds of the formula $[RX]_m AOOH$ are described, wherein R is a hydrocarbyl or alkoxylated hydrocarbyl, for example, $R(OCH_2CH_2)_y$; and wherein X is a heteroatom-containing moiety, e.g., O, $SO_2$, $N(R'_2)_2$, $P(R'_2)_2$, $N(R')\rightarrow O$ or $P(R')\rightarrow O$ with R' being hydrogen or alkyl, and m being an integer. Preferably R' is a $C_1$-$C_{20}$ hydrocarbyl (including alkyl, alkenyl, alkynyl, alkylaryl; branched or straight-chain or substituted), more preferably a $C_6$-$C_{20}$ alkyl, a $C_6$-$C_{20}$ alkenyl or a $C_6$-$C_{20}$ substituted aryl. R' being a $C_6$-$C_{15}$ alkyl is especially preferred for oxidative stability. Also, the hydrocarbyl groups are optionally alkoxylated (i.e. linked to one or more ethyleneoxy or propyleneoxy groups or mixtures thereof. For m=1, A is —C(O)—$(CH_2)_x$—C(O)—, —C(O)—(R")—C(O)—; —$(CH_2)_z$—C(O)—; —C(O)—CH═CH—C(O)—, or —C(O)—$C_6H_4$—C(O)—, wherein x is an integer from 0 to 4, y is an integer of 0 to 10, z is an integer from 0 to 2, and R" is a branched-chain alkylene, generally $C_3$-$C_{15}$. For m=2, A is —CH—C(O)—. Preferred compounds herein are those wherein X is oxygen. Processes for the preparation of such peracid compounds are also described in EP 0 166 571. Preferred starting materials for such peracid components which are suitable for use in the present invention are Dobanol® 45-E7, Dobanol® 91-E5 and Coconut-Ethoxylate-E1.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

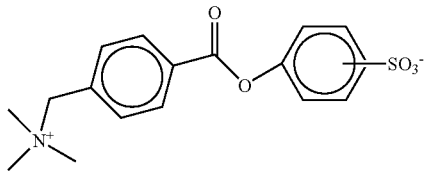

A preferred cationically substituted alkyl oxybenzene sulfonate has the formula:

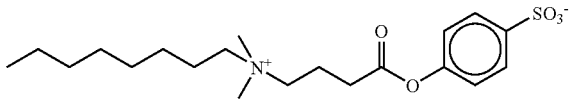

Preferred cationic peroxyacid precursors of the N-acylated caprolactam class include the trialkyl ammonium methylene benzoyl caprolactams, particularly trimethyl ammonium methylene benzoyl caprolactam:

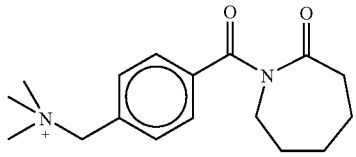

Other preferred cationic peroxyacid precursors of the N-acylated caprolactam class include the trialkyl ammonium methylene alkyl caprolactams:

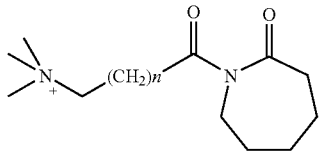

wherein n is from 0 to 12, particularly from 1 to 5.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N—,N,N$^1$N$^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide Substituted Alkyl Peroxyacid Precursors

Amide substituted alkyl peroxyacid precursor compounds are also suitable, including those of the following general formulae:

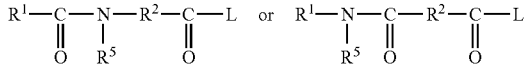

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Benzoxazin Organic Peroxyacid Precursors

Also suitable are precursor compounds of the benzoxazin-type, as disclosed for example in EP-A-332,294 and EP-A-482,807, particularly those having the formula:

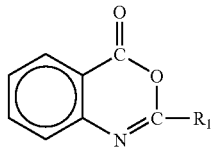

including the substituted benzoxazins of the type

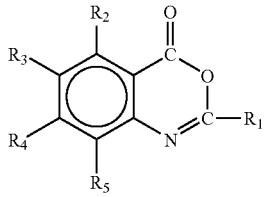

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

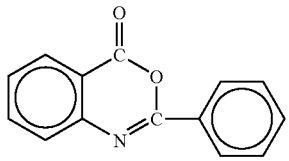

Preformed Organic Peroxyacid

The organic peroxyacid bleaching system may contain, in addition to, or as an alternative to, an organic peroxyacid bleach precursor compound, a preformed organic peroxyacid.

A preferred class of organic peroxyacid compounds are the amide substituted compounds of the following general formulae:

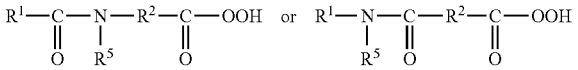

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid, and diperoxyhexadecanedioc acid. Dibenzoyl peroxide is a preferred organic peroxyacid herein. Mono- and diperazelaic acid, mono- and diperbrassylic acid, and N-phthaloylaminoperoxicaproic acid are also suitable herein.

Other Preferred Bleach Precursors:

Other organic bleach precursor includes the electrophilic oxidizing agent such as the oxaziridinium ions. One preferred oxaziridinium is sulfuric acid, mono-[2-(3,4-dihydroisoquinolin-2-yl)-1-(2-ethyl-hexyloxymethyl)-ethyl] ester. One more preferred embodiment of this present invention is to use a composition comprising complexes of one or both oxaziridinium and bleach activator with the source of oxygen.

3,2 Brightener

Brighteners are compounds which have the ability to fluorescent by absorbing ultraviolet wave-lengths of light and re-emitting visible light. Brighteners, also referred to as fluorescent whitening agents (FWA), have been extensively described in the art, see for instance EP-A-0 265 041, EP-A-0 322 564, EP-A-0 317 979 or "Fluorescent whitening agents" by A. K. Sarkar, published by MERROW, especially page 71-72.

Suitable commercially available brighteners can be classified into subgroups, which include, but are not necessarily limited to, derivatives of stilbene, pyrazoline, coumarin, carboxylic acid, methinecyanine, dibenzothiophene-5,5-dioxide, azole, 5- and 6-membered-ring heterocycle, and other miscellaneous agents. Examples of such brighteners are disclosed in "The Production and Application of Fluorescent Brightening Agents", M. Zahradnik, Published by John Wiley & Sons, New York (1982). Further optical brighteners which may also be used in the present invention include naphthlimide, benzoxazole, benzofuran, benzimidazole and any mixtures thereof. Particularly preferred brighteners for use herein are the derivatives of stilbene and mixtures thereof.

Specific examples of brighteners useful herein include 4-methyl-7-diethyl-amino coumarin; 1,2-bis(-benzimidazol-2-yl)-ethylene; 1,3-diphenyl-pyrazolines; 2,5-bis(-benzoxazol-2-yl)-thiophene; 2-styryl-naphtho-[1,2-d]-oxazole; 2-(stilbene-4-yl)-2H-naphtho-[1,2-d]-triazole; 3-phenyl-7-(isoindolinyl) coumarin; 3-methyl-7-(isoindolinyl) coumarin; 3-chloro-7-(isoindolinyl) coumarin; 4-(isoindolinyl)-4'-methylstilbene; 4-(isoindolinyl)-4'-methoxystilbene; sodium 4-(isoindolinyl)-4'-stilbenesulfonate; 4-(isoindolinyl)-4'-phenylstilbene; 4-(isoindolinyl)-3-methoxy-4'-methylstilbene; 4-(2-chloroisoindolinyl)-4'-(2-methylisoindolinyl)-2,2'-stilbenedisosulfonic acid; disodium 4,4'-diisoindolinyl-2,2'-stilbene disulfonate; 4,4'-diisoindolinyl-2,2'-stilbenedisulfonamide; disodium 4,4'-(7,8-dichloro-1-isoindolinyl)-2,2-stilbenedisulfonate; disodium 4,4'-(7-chloro-1-isoindolinyl)-2,2-stilbenedisulfonate; disodium 4,4'-(6-Isopropoxy-1-isoindolinyl)-2,2-stilbenedisulfonate; disodium 4,4'-(7,8-diisopropyl-1-isoindolinyl)-2,2-stilbenedisulfonate; disodium 4,4'-(7-butoxy-1-isoindolinyl)-2,2-stilbenedisulfonate; disodium 4,4'-(6-trifluoromethyl-1-isoindolinyl)-2,2-stilbenedisulfonate; disodium 4,4'-[6-(1,4,7-trioxanonyl)-1-isoindolinyl)]-2,2-stilbenedisulfonate; disodium 4,4'-(7-methoxymethyl-1-isoindolinyl)-2,2-stilbenedisulfonate; disodium 4,4'-(6-phenyl-1-isoindolinyl)-2,2-stilbenedisulfonate; disodium 4,4'-(6-naphthyl-1-isoindolinyl)-2,2-stilbenedisulfonate; disodium 4,4'-(6-methylsulfonyl-1-isoindolinyl)-2,2-stilbenedisulfonate; disodium 4,4'-(7-cyano-1-isoindolinyl)-2,2-stilbenedisulfonate; disodium 4,4'-[7-(1,2,3-trihydroxypropyl)-1-isoindolinyl)]-2,2-stilbenedisulfonate; disodium 4-isoindolinyl-4'-ethoxy-2,2'-stilbenedisulfonate; disodium 4-isoindolinyl-4'-methoxy-2,2'-stilbenedisulfonate; disodium 4-isoindolinyl-4'-ethoxy-2,2'-stilbenedisulfonamide; disodium 4-isoindolinyl-4'-methyl-2,2'-stilbenedisulfonamide; disodium 4,4'-bis-(2-diethanolamino-4-anilino-s-triazin-6-ylamino)-stilbene-2:2 disulphonate; disodium 4,4'-bis-(2-morpholino-4-anilino-s-triazin-6-ylamino)-stilbene-2:2'-disulphonate; disodium 4,4'-bis-(2,4-dianilino-s-triazin-6-ylamino)-stilbene-2-sulphonate; monosodium 4,4"-bis-(2,4-dianilino-s-triazin-6-ylamino)-stilbene-2:2'-disulphonate; disodium 4,4'-bis-(2-anilino-4-(N-methyl-N-2-hydroxyethylamino)-s-triazin-6-ylamino)stilbene-2,2'-disulphonate; disodium 4,4'-bis-(4-phenyl-2,1,3-triazol-2-yl)-stilbene-2,2' disulphonate; disodium 4,4'-bis-(2-anilino-4-(1-methyl-2-hydroxyethylamino)-s-triazin-6-ylamino)-stilbene-2,2'-disulphonate; sodium 2-(stilbyl-4"-(naphtho-1',2':4,5)-1,2,3-triazole-2"-sulphonate, 4,4'-bis-(2-sulphostyryl)-bip 4,4'-bis (4-phenyl-2H-1,2,3-triazol-2-yl)-2,2'-stilbenedisulfonic acid and mixture thereof. See also U.S. Pat. Nos. 3,646,015, 3,346,502 and 3,393,153 for further examples of brighteners useful herein.

Indeed one of the functionally equivalent derivative salts of 4,4'-bis(4-phenyl-2H-1,2,3-triazol-2-yl)-2,2'-stilbenedisulfonic acid, namely its sodium salt is available from Mobay Chemical Corporation, a subsidiary of Bayer AG under the name Phorwite® CAN. The amine salt is available from Molay under the name Phorwite® CL solution. The potassium salt is available under the name Phorwite® BHC 766.

Specific examples of hydrophilic optical brighteners useful in the present invention are those having the structural formula:

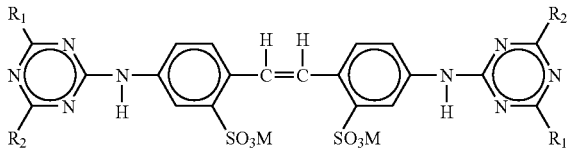

wherein $R_1$ and $R_2$ are selected from hydrogen, C1-C30 alkyl, C6-C30 aryl, C1-C30 alkylamino chloro, hydroxy, C1-C30 alkylhydroxy, amino, C1-C30 alkylamino, C1-C1-C30 dialkylamino, anilino, N-2-bis-hydroxyethyl, NH-2-hydroxyethyl, N-2-hydroxyethyl-N-methylamino, morpholino, chloro, and mixtures thereof; and M is a salt-forming cation such as sodium or potassium.

Preferred are brighteners comprising at least one anilino moiety such as C.I. Fluorescent Brightener® 32, also known as Blankophor® B, and further comprising an hydroxyl moiety. Also preferred are brighteners comprising a morpholino or N-2-bis-hydroxyethyl moiety such as C.I. Fluorescent Brightener® 15 and C.I. Fluorescent Brightener® 36.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by from Ciba Specialty Chemicals. Tinopal-UNPA-GX® is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by from Ciba Specialty Chemicals.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by from Ciba Specialty Chemicals.

One of the most preferred fluorescent whitening agents suitable for use in the present invention are substituted stilbene 2,2'-disulfonic acid derivatives, which also include 4-4'-bis (2-2' styryl sulfonate) biphenyl having the structural formula:

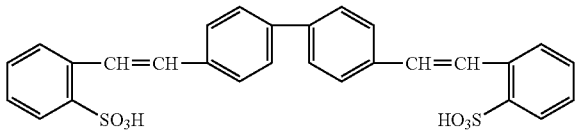

• 2 Na

Suitable 4-4'-bis (2-2' styryl sulfonate) biphenyl are commercially available from Ciba Specialty Chemicals under the trade name Brightener 49® or Tinopal CBS® or other hydrophilic brighteners like for example Brightener 3®) or Brightener 47®, also commercially available from Ciba Specialty Chemicals.

Other specific examples of hydrophobic brighteners useful in the present invention include the polycyclic oxazole derivatives such as benzo-oxazole derivatives, or mixtures thereof and particularly preferred herein the benzo-oxazole derivatives. An example of such a brightener is benzoxazole, 2,2'-(thiophenaldyl)bis having the following formula $C_{18}H_{10}N_2O_2S$, commercially available from Ciba Specialty Chemicals under the trade name Tinopal SOP®. This brightener is almost insoluble in water, i.e. it has a solubility being lower than 1 gram per liter. Another example of such a brightener is bis(sulfobenzofuranyl)biphenyl, commercially available from Ciba Specialty Chemicals under the trade name Tinopal PLC®.

By "hydrophobic brighteners", it is meant any brightener having a solubility such that no more than 10 grams of brightener can be fully dissolved in 1 liter of deionized water at 25° C. By "fully dissolved" it is meant that a clear and stable solution is obtained. Accordingly, by "hydrophilic brighteners", it is to be understood herein any brightener having a solubility such that more than 10 grams of brightener can be fully dissolved in 1 liter of deionized water at 25° C.

Preferably, for the preparation of the complexes of the present invention, brighteners selected from the group consisting of hydrophobic brighteners, hydrophilic brighteners and mixtures thereof are used.

Further examples include Tinopal CBS-X®, available from Ciba Specialty Chemicals; Artic White CC® and Artic White CWD®; the 2-(4-styryl-phenyl)-2H-naphtho[1,2-d] triazoles; 4,4'-bis(1,2,3-triazol-2-yl)-stilbenes; 4,4'-bis (styryl)bisphenyls; and the aminocoumarins. Other examples including brighteners are those identified in U.S. Pat. No. 4,790,856. Other brighteners disclosed are the PHORWHITE® series of brighteners from Verona.

Other preferred brighteners suitable for incorporation into the complexes and compositions of the present invention are distyryl benzene brighteners such as 1,4-di(2-cyanostyryl) benzene commercially available as Palanil Brilliant white R from BASF [CAS-No. 1300139-3]; divinylstilbene brighteners such as 4,4'-di(ethoxycarbovinyl)stilbene commercially available as Leucophor EHB from Clariant [CAS-No. 60683-03-6]; stilbene-2H-triazole brighteners such as cyano-chloro 2-(stilben-4-yl)naphtho[1,2-d]triazole commercially available from Geigy (U.S. Pat. No. 2,972,611) [CAS-No. 55516-20-1]; stilbenylbenzoxazole brighteners such as 5,7-dimethyl-2-(4'-phenylstilben-4-yl)benzoxazole commercially available from Ciba Geigy (U.S. Pat. No. 3,850,914) [CAS-No. 40704-04-9], bis(benzoxazole) bis(4, 4'-benzoxazole)stilbene commercially available from Kodak (U.S. Pat. No. 3,260,715 & U.S. Pat. No. 3,322,680) and Hoechst (U.S. Pat. No. 4,585,875) [CAS-No. 1533-45-3];

and pyrazoline based brighteners such as 1-(4-methylsulphonylphenyl)-3(4chlorophenyl)-2-pyrazoline commercially available from Bayer (U.S. Pat. No. 3,378,389) [CAS-No. 60650-43-3]. These brighteners are especially useful and beneficial for use on acrylic-, wool-, silk-, polyacetate-, nylon-, polyamide- and/or polyester-containing fibers and fabrics and/or blends of such fibers and fabrics.

3,3 Fabric Softening Agent

In general, any fabric softening agent can be used in the preparation of the complexes and compositions of the present invention.

Quaternary-Ammonium Fabric Softener Actives

Typical preferred cationic fabric softening components include the water-insoluble quaternary-ammonium fabric softening actives or their corresponding amine precursor, the most commonly used having been di-long alkyl chain ammonium chloride or methyl sulfate. Preferred cationic softeners among these include the following:

1) ditallow dimethylammonium chloride (DTDMAC);
2) dihydrogenated tallow dimethylammonium chloride;
3) dihydrogenated tallow dimethylammonium methylsulfate;
4) distearyl dimethylammonium chloride;
5) dioleyl dimethylammonium chloride;
6) dipalmityl hydroxyethyl methylammonium chloride;
7) stearyl benzyl dimethylammonium chloride;
8) tallow trimethylammonium chloride;
9) hydrogenated tallow trimethylammonium chloride;
10) $C_{12-14}$ alkyl hydroxyethyl dimethylammonium chloride;
11) $C_{12-18}$ alkyl dihydroxyethyl methylammonium chloride;
12) ditallow imidazolinium methylsulfate;
13) 1-(2-tallowylamidoethyl)-2-tallowyl imidazolinium methylsulfate; and mixtures of any of the above materials.

Biodegradable quaternary ammonium compounds have been presented as alternatives to the traditionally used di-long alkyl chain ammonium chlorides and methyl sulfates. Such quaternary ammonium compounds contain long chain alk(en)yl groups interrupted by functional groups such as carboxy groups. These materials and fabric softening compositions containing them are disclosed in numerous publications such as EP-A-0,040,562, and EP-A-0,239,910.

The quaternary ammonium compounds and amine precursors herein have the formula (I) or (II), below:

(I)

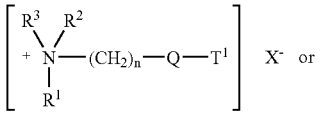

(II)

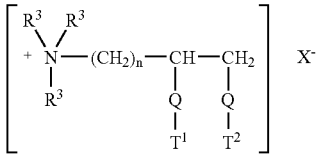

wherein Q is selected from —O—C(O)—, —C(O)—O—, —O—C(O)—O—, —$NR^4$—C(O)—, —C(O)—$NR^4$—;

$R^1$ is $(CH_2)_n$-Q-$T^2$ or $T^3$;

$R^2$ is $(CH_2)_m$-Q-$T^4$ or $T^5$ or $R^3$;

$R^3$ is $C_1$-$C_4$ alkyl or $C_1$-$C_4$ hydroxyalkyl or H;

$R^4$ is H or $C_1$-$C_4$ alkyl or $C_1$-$C_4$ hydroxyalkyl;

$T^1$, $T^2$, $T^3$, $T^4$, $T^5$ are independently $C_{11}$-$C_{22}$ alkyl or alkenyl;

n and m are integers from 1 to 4; and $X^-$ is a softener-compatible anion. Non-limiting examples of softener-compatible anions include chloride or methyl sulfate.

The alkyl, or alkenyl, chain $T^1$, $T^2$, $T^3$, $T^4$, $T^5$ must contain at least 11 carbon atoms, preferably at least 16 carbon atoms. The chain may be straight or branched. Tallow is a convenient and inexpensive source of long chain alkyl and alkenyl material. The compounds wherein $T^1$, $T^2$, $T^3$, $T^4$, $T^5$ represents the mixture of long chain materials typical for tallow are particularly preferred.

Specific examples of quaternary ammonium compounds suitable for use in the aqueous fabric softening compositions herein include:

1) N,N-di(tallowyl-oxy-ethyl)-N,N-dimethyl ammonium chloride;
2) N,N-di(tallowyl-oxy-ethyl)-N-methyl, N-(2-hydroxyethyl) ammonium methyl sulfate;
3) N,N-di(2-tallowyl-oxy-2-oxo-ethyl)-N,N-dimethyl ammonium chloride;
4) N,N-di(2-tallowyl-oxy-ethylcarbonyl-oxy-ethyl)-N,N-dimethyl ammonium chloride;
5) N-(2-tallowyl-oxy-2-ethyl)-N-(2-tallowyl-oxy-2-oxo-ethyl)-N,N-dimethyl ammonium chloride;
6) N,N,N-tri(tallowyl-oxy-ethyl)-N-methyl ammonium chloride;
7) N-(2-tallowyl-oxy-2-oxo-ethyl)-N-(tallowyl-N,N-dimethyl-ammonium chloride; and
8) 1,2-ditallowyl-oxy-3-trimethylammoniopropane chloride;
9) di(stearoyloxyethyl) dimethylammonium chloride (DSOEDMAC);

and mixtures of any of the above materials.

In another embodiment of the present invention, the quaternary-ammonium fabric softener active is combined with at least one source of acid. Preferably, the quaternary-ammonium fabric softener active is combined with at least one source of acid before combination with cyclodextrin. Typically, the molar ratio between the quaternary-ammonium fabric softener active and the source of acid is from 50:1 to 1:50, preferably from 5:1 to 1:5, more preferably from 2:1 to 1:2 and even more preferably from 1.5:1 to 1:1.5. The most preferred molar ratio between the quaternary-ammonium fabric softener active and the source of acid is 1:1.

Without wishing to be bound by theory, the inventors believe that the source of acid, when in combination with the quaternary-ammonium fabric softener active, protects the quaternary-ammonium fabric softener active from interactions with the other laundry adjunct materials of the composition. In addition, the inventors believe that the source of acid, especially when the source of acid is a $C_{12}$-$C_{22}$ fatty acid or even an anionic derivative of a $C_{12}$-$C_{22}$ fatty acid, deposits on the surface of the fabric, whereupon it lubricates the fabric fibres at or near the fabric surface, and thus, softens the fabric.

The source of acid is selected from the group consisting of: $C_{12}$-$C_{22}$ fatty acids, mono-alkyl esters of a $C_{12}$-$C_{22}$ alkyl sulphuric acids, $C_{11}$-$C_{13}$ alkyl benzene sulphonic acids, anionic derivatives thereof, salts thereof, and combinations thereof. The term "anionic derivative" is typically intended to include dissociated acids. Preferably, the source of acid is selected from the group consisting of $C_{12}$-$C_{22}$ fatty acids, anionic derivatives thereof, salts thereof, and combinations thereof. More preferably, the source of acid is selected from $C_{12}$-$C_{22}$ fatty acids, anionic derivatives thereof, and combinations thereof. Most preferably, the source of acid is selected from $C_{12}$-$C_{22}$ fatty acids.

$C_{12}$-$C_{22}$ fatty acids can be represented by the formula:

$$R^5—COOH$$

wherein $R^5$ is a $C_{11}$-$C_{21}$ alkyl group. Salts of fatty acids can be represented by the formula:

$$R^5—COO^-M^+,$$

wherein $M^+$ is an alkali metal ion, preferably $Na^+$ and/or $K^+$, and $R^1$ is a $C_{11}$-$C_{21}$ alkyl group. Anionic derivatives of fatty acids can be represented by the formula $$R^5—COO^-$$

wherein $R^5$ is a $C_{11}$-$C_{21}$ alkyl group.

Preferred sources of $C_{12}$-$C_{22}$ fatty acids are selected from the group consisting of: lauric acid, tridecylic acid, myristic acid, pentadecylic acid, palmitic acid, margaric acid, stearic acid, arachidic acid, phytanic acid, behenic acid, anionic derivatives thereof, salts thereof, and combinations thereof. Most preferably, the source of acid is stearic acid.

Preferred sources of acid are $C_{12}$-$C_{22}$ fatty acids comprising a saturated alkyl group. Other preferred sources of acids are $C_{12}$-$C_{22}$ fatty acids comprising an unsaturated group, typically having an iodine value of from 15 to 25, preferably from 18 to 22.

The source of acid may be selected from the group consisting of palmitoleic acid, oleic acid, elaidic acid, vaccenic acid, linoleic acid, cis-eleostearic acid, trans-eleostearic acid, linolenic acid, arachidonic acid, anionic derivatives thereof, salts thereof, and combinations thereof.

Preferred sources of fatty acids are selected from the group consisting of coconut, soybean, tallow, palm, palm kernel, rapeseed, lard, sunflower, corn, safflower, canola, olive, peanut, and combinations thereof. A highly preferred source of fatty acid is tallow.

Preferred unsaturated fatty acids have a cis: trans isomer ratio of from 200:1 to 1:1, preferably from 200:1 to 10:1. A preferred source of acid is hard tallow fatty acid and/or partially hydrogenated tallow fatty acid.

The source of acid maybe a $C_{11}$-$C_{13}$ alkyl benzene sulphonic acid. The source of acid may be an anionic derivative or a salt of a $C_{11}$-$C_{13}$ alkyl benzene sulphonic acid. The source of acid may be a mono-alkyl ester of a $C_{12}$-$C_{22}$ alkyl sulphuric acid. The acid source may be an anionic derivative or a salt of a mono-alkyl ester of a $C_{12}$-$C_{22}$ alkyl sulphuric acid. A preferred source of a mono-alkyl ester of a $C_{12}$-$C_{22}$ alkyl sulphuric acid is tallow alkyl sulphate.

Cationic-Anionic Ion Pair Complex

If the source of acid is an anionic derivative of an acid selected from the group consisting $C_{12}$-$C_{22}$ fatty acid, mono-alkyl ester of a $C_{12}$-$C_{22}$ alkyl sulphuric acid, $C_{11}$-$C_{13}$ alkyl benzene sulphonic acid, and combinations thereof, then it may be preferred that the cationic quaternary ammonium component and source of acid are in the form of a cationic-anionic ion-pair complex. The cationic-anionic ion pair complex can be represented by the formulas:

(III)

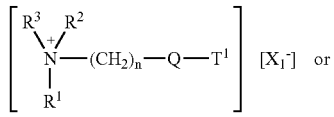

(IV)

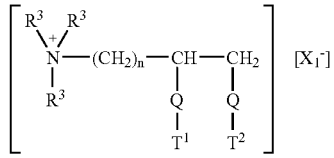

wherein Q is selected from —O—C(O)—, —C(O)—O—, —O—C(O)—O—, —$NR^4$—C(O)—, —C(O)—$NR^4$—;
$R^1$ is $(CH_2)_n$-Q-$T^2$ or $T^3$;
$R^2$ is $(CH_2)_m$-Q-$T^4$ or $T^5$ or $R^3$;
$R^3$ is $C_1$-$C_4$ alkyl or $C_1$-$C_4$ hydroxyalkyl or H;
$R^4$ is H or $C_1$-$C_4$ alkyl or $C_1$-$C_4$ hydroxyalkyl;
$T^1$, $T^2$, $T^3$, $T^4$, $T^5$ are independently $C_{11}$-$C_{22}$ alkyl or alkenyl;

n and m are integers from 1 to 4; and $X^-$ is an anionic derivative of an acid selected from the group consisting $C_{12}$-$C_{22}$ fatty acids, mono-alkyl esters of a $C_{12}$-$C_{22}$ alkyl sulphuric acids, $C_{11}$-$C_{13}$ alkyl benzene sulphonic acids, and combinations thereof.

Preferably, $X^-$ is represented by the formula:

$$R^5—COO^- \text{ or } R^5—OSO_3—$$

wherein $R^5$ is a $C_{11}$-$C_{21}$ alkyl group. Most preferably, $X_1^-$ is represented by the formula:

$$R^5—COO^-$$

wherein $R^5$ is a $C_{11}$-$C_{21}$ alkyl group.

The cationic-anionic complex can be obtained by any conventional process. A typical process involves the following four steps: 1. Esterification of an appropriate aminoalcohol with fatty acid to give an esteramine. 2. Quaternization of the esteramine with a suitable quaternizing agent in an alcoholic solvent. 3. Treatment of the alcoholic quaternary solution with a fatty acid salt. 4. Removal of the resultant insoluble inorganic salt.

The cationic-anionic complex may also be obtainable, preferably obtained, by a process comprises the steps of: (i) obtaining a mixture comprising a solvent, a quaternary ammonium fabric softener active and a source of acid, wherein the quaternary ammonium fabric softener active is in the form of a complex with a counter-anion, and wherein the source of acid is a salt of one or more acids selected from the group consisting of: $C_{12}$-$C_{22}$ fatty acid, mono-alkyl ester of a $C_{12}$-$C_{22}$ alkyl sulphuric acid, $C_{11}$-$C_{13}$ alkyl benzene sulphonic acid, and combinations thereof; and (ii) desalting the mixture to form a cationic-anionic complex.

Preferred solvents are $C_1$-$C_5$ alcohols and isomers. Other preferred solvents are heptane and/or hexane. A highly preferred solvent selected from methanol, ethanol, isopropanol, and combinations thereof. Preferred processes for obtaining a mixture comprising a quaternary ammonium fabric softener active and a source of acid that can be used to obtain the mixture in step (i), are described in WO 03/050218 (P&G, published Jun. 19, 2003). A preferred desalting means is selected from filtration, decanting, sedimentation, extraction, centrifugation, and combinations thereof.

Clays

Typical preferred softening components include the water-insoluble clays. In general, any clay can be incorporated into the compositions of the present invention. Typically, the clay is selected from the group consisting of: allophane clays; chlorite clays, preferred chlorite clays are amesite clays, baileychlore clays, chamosite clays, clinochlore clays, cookeite clays, corundophite clays, daphnite clays, delessite clays, gonyerite clays, nimite clays, odinite clays, orthochamosite clays, pannantite clays, penninite clays, rhipidolite clays, sudoite clays and thuringite clays; illite clays; inter-stratified clays; iron oxyhydroxide clays, preferred iron oxyhydoxide clays are hematite clays, goethite clays, lepidocrite clays and ferrihydrite clays; kaolin clays, preferred kaolin clays are kaolinite clays, halloysite clays, dickite clays, nacrite clays and hisingerite clays; smectite clays; vermiculite clays; and mixtures thereof.

Preferably, the clay is a smectite clay. Preferred smectite clays are beidellite clays, hectorite clays, laponite clays, montmorillonite clays, nontonite clays, saponite clays and mixtures thereof. Preferably, the smectite clay is a dioctahedral smectite clay. Preferred dioctahedral smectite clays are montmorillonite clays. The montmorillonite clay may be a low-charged montmorillonite clay (also known as sodium montmorillonite clay or Wyoming-type montmorillonite clay). The montmorillonite clay may be a high-charged montmorillonite clay (also known as calcium montmorillonite clay or Cheto-type montmorillonite clay).

The clay may be a light coloured crystalline clay mineral, preferably having a reflectance of at least 60, more preferably at least 70, or at least 80 at a wavelength of 460 nm. Preferred light coloured crystalline clay minerals are china clays, halloysite clays, dioctahedral clays such as kaolinite, trioctahedral clays such as antigorite and amesite, smectite and hormite clays such as bentonite (montmorillonite), beidilite, nontronite, hectorite, attapulgite, pimelite, mica, muscovite and vermiculite clays, as well as pyrophyllite/talc, willemseite and minnesotaite clays. Preferred light coloured crystalline clay minerals are described in GB2357523A and WO01/44425.

The clays herein are available under commercial names such as "Fuller's earth" (clay found in a relatively thin vein above the main bentonite or monmorillonite veins in the Black Hills) and various tradenames such as Thixogel #1 (also, "Thixo-Jell") and Gelwhite GP from Georgia Kaolin Co. Elizabeth, N.J.; Volclay BC and Volclay #325, from American Colloid Co., Skokie, Ill.; Black Hills Bentonite BH 450, from International Minerals and Chemicals; and Veegum Pro and Veegum F, from R. T. Vanderbuilt. It is to be recognized that such smectite-type minerals obtained under the foregoing commercial and tradenames can comprise mixtures of the various discrete mineral entitites. Such mixtures of the smectite minerals are suitable for use herein. Examples of hectorite clays suitable for the present compositions include Bentone EW and Macaliod, from NL Chemicals, N.J., U.S., and hectorites from Industrial Mineral Ventures.

Highly preferred are organophilic clays as available from Rheox/Elementis, such as Bentone SD-1 and Bentone SD-3, which are registered trademarks of Rheox/Elementis.

Nitrogen-free Silicone Polymers

Typical preferred softening components include nitrogen-free silicone polymers. The nitrogen-free silicone polymers include nonionic, zwitterionic and amphoteric nitrogen-free silicone polymers.

Preferably, the nitrogen-free silicone polymer is selected from nonionic nitrogen-free silicone polymers having the formulae (I) to (III):

(I)

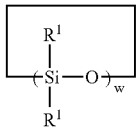

(II)

$$R^2—(R^1)_2SiO—[(R^1)_2SiO]_a—[(R^1)(R^2)SiO]_b—Si(R^1)_2—R^2$$

(III)

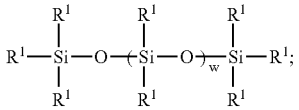

and mixtures thereof, wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and mixtures thereof; each $R^2$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and from a poly(ethyleneoxide/propyleneoxide) copolymer group having the general formula (IV):

$$—(CH_2)_nO(C_2H_4O)_c(C_3H_6O)_dR^3 \quad (IV)$$

with at least one $R^2$ being a poly(ethyleneoxy/propyleneoxy) copolymer group, and each $R^3$ is independently selected from the group consisting of hydrogen, an alkyl having 1 to 4 carbon atoms, and an acetyl group, wherein the index w has the value as such that the viscosity of the nitrogen-free silicone polymer of formulae (I) and (III) is between $2\cdot10^{-6}$ $m^2/s$ (2 centistokes at 20° C.) and 50 $m^2/s$ (50,000,000 centistokes at 20° C.); wherein a is from 1 to 50; b is from 1 to 50; n is 1 to 50; total c (for all polyalkyleneoxy side groups) has a value of from 1 to 100; total d is from 0 to 14; total c+d has a value of from 5 to 150.

More preferably, the nitrogen-free silicone polymer is selected from linear nonionic nitrogen-free silicone polymers having the formulae (II) to (III) as above, wherein $R^1$ is selected from the group consisting of methyl, phenyl, and phenylalkyl; wherein $R^2$ is selected from the group consisting of methyl, phenyl, phenylalkyl and from the group having the general formula (IV), defined as above; wherein $R^3$ is defined as above and wherein the index w has the value as such that the viscosity of the nitrogen-free silicone polymer of formula (III) is between 0.01 $m^2/s$ (10,000 centistokes at 20° C.) and 0.8 $m^2/s$ (800,000 centistokes at 20° C.); a is from 1 to 30, b is from 1 to 30, n is from 3 to 5, total c is from 6 to 100, total d is from 0 to 3, and total c+d is from 7 to 100.

Most preferably, the nitrogen-free silicone polymer is selected from linear nonionic nitrogen-free silicone polymers having the formula (III) as above, wherein $R^1$ is methyl and wherein the index w has the value as such that the viscosity of the nitrogen-free silicone polymer of formula (III) is between 0.06 $m^2/s$ (60,000 centistokes at 20° C.) and 0.7 $m^2/s$ (700,000 centistokes at 20° C.) and more preferably between 0.1 $m^2/s$ (100,000 centistokes at 20° C.) and 0.48 m 2/s (480,000 centistokes at 20° C.), and mixtures thereof.

Non-limiting examples of nitrogen-free silicone polymers of formula (II) are the Silwet® compounds which are available from OSi Specialties Inc., a Division of Witco, Danbury, Conn., USA. Non-limiting examples of nitrogen-free silicone polymers of formula (I) and (III) are the Silicone 200 fluid series from Dow Corning.

Nitrogen-containing Silicone Polymers

Typical preferred softening components include nitrogen-containing silicone polymers. Herein "nitrogen-containing" means any amine functionalized silicone; i.e., a silicone containing at least one primary amine, secondary amine, or tertiary amine. Quaternized amino-functionalized silicones, i.e. quaternary ammonium silicones, are also enclosed in the definition of functionalised silicones for the purpose of the present invention. Preferred aminosilicones have a mole % nitrogen content in the range from 0.01 mole % to 10 mole %, more preferably from 0.05 mole % to 1.0 mole %, and most preferably from 0.3 mole % to 0.5 mole %.

Typically, the aminosilicone has a viscosity of from 0.001 $m^2/s$ (1,000 centistokes at 20° C.) to 0.05 $m^2/s$ (50,000 centistokes at 20° C.), more preferably 0.002 $m^2/s$ (2,000 centistokes at 20° C.) to 0.03 $m^2/s$ (30,000 centistokes at 20° C.), more preferably from 0.004 m 2/s (4,000 centistokes at 20° C.) to 0.02 $m^2/s$ (20,000 centistokes at 20° C.)

Examples of preferred aminosilicones for use in the compositions of the present invention include but are not limited to, those which conform to the general formula (V):

$$(R_1)_aG_{3-a}\text{-Si}—(—OSiG_2)_n\text{-}(—OSiG_b(R_1)_{2-b})_m—O—SiG_{3-a}(R_1)_a \quad (V)$$

wherein G is hydrogen, phenyl, hydroxy, or $C_1$-$C_8$ alkyl, preferably methyl; a is 0 or an integer having a value from 1 to 3, preferably 1; b is 0, 1 or 2, preferably 1; n is a number from 0 to 1,999, preferably from 49 to 500; m is an integer from 1 to 2,000, preferably from 1 to 10; the sum of n and m is a number from 1 to 2,000, preferably from 50 to 500; $R_1$ is a monovalent radical conforming to the general formula $C_qH_{2q}L$, wherein q is an integer having a value from 2 to 8 and L is selected from the following groups: $—N(R_2)CH_2—CH_2—N(R_2)_2$; $—N(R_2)_2$; wherein $R_2$ is hydrogen, phenyl, benzyl, or a saturated hydrocarbon radical, preferably an alkyl radical from $C_1$ to $C_{20}$.

A preferred aminosilicone corresponding to formula (V) is the shown below in formula (VI):

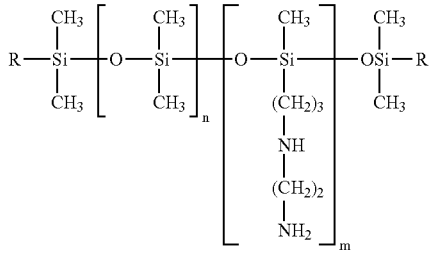

(VI)

wherein R is independently selected from C1 to C4 alkyl, alkoxy, hydroxyalkyl and mixtures thereof, preferably from methyl and methoxy. When both R groups are methyl, the above polymer is known as "trimethylsilylamodimethicone".

Most preferred amino silicones are those commercially available from Wacker, sold under the tradename of Wacker Belsil® ADM 1100 and Wacker Finish® WR 1100, and from General Electric sold as General Electric® SF 1923.

Cationic Silicone Polymer

Typical preferred softening components include cationic silicone polymers. In general, any cationic silicone polymer can be incorporated into the compositions of the present invention. Preferred cationically charged functionalized silicones are disclosed in the Applicant's co-pending applications WO 02/018 528 and EP 02 447 167.4.

Synthesis Example—When not otherwise known or available in commerce, the cationic silicone polymers herein can be prepared by conventional techniques as disclosed in WO 02/18 528.

Anionic Silicone Polymers

Typical preferred softening components include anionic silicone polymers. In general, any anionic silicone polymer can be incorporated into the compositions of the present invention. Preferred anionic silicone polymers are selected from the group consisting of silicones comprising at least one carboxylate, sulfate, sulfonate, phosphate or phosphonate group and derivatives thereof and mixtures thereof. Most preferred anionic silicone-containing polymers are those commercially available from BASF, sold under the tradename of Densodrin® OF and Densodrin® SI; from OSi/Crompton, sold under the tradename of FZ-3703®; from Toray/Dow Corning Silicones, sold under the tradename of BY 16-750® and BY 16-880®; from Noveon/BF Goodrich, sold under the tradename of Ultrasil® CA-1; from Shin Etsu, sold under the tradename of X22-3701E® and from Wacker, sold under the tradename of M-642®.

Mixtures of more than one fabric softening agent may also be used in the complexes and compositions of the present invention. In particular, it is preferred to utilize two or more different fabric softening agents in the complexes and compositions of the present invention. For the mixtures of such fabric softening agents, any mixtures of fabric softening agents may be utilized as disclosed in the above description, subject to physical and chemical stability of such mixtures of fabric softening agents, either alone, and/or in the complexes and/or in the compositions of the present invention.

4, Solvent

The steps of the present invention are carried out in the presence of at least one solvent. Preferably, the solvent has a boiling point below 200° C., more preferably below 150° C., and most preferably below 105° C. The solvent suitable for use in the steps of the present invention can be anhydrous or hydrous; and can include water alone or organic solvents alone and/or mixtures thereof. Preferred organic solvents include methanol, ethanol, propanol, isopropanol, butanol, isobutanol, tert-butanol, pentanol, and mixtures thereof. Other lower alcohols, $C_1$-$C_4$ alkanolamines such as monoethanolamine and triethanolamine, can also be used. Typically, the solvent is present at levels in the range of from 0.1% to 98%, preferably at least 10% to 95%, more usually from 25% to 75% by weight of all components present.

It is preferred that the steps of the present invention in carried out in the absence of any additional polyhydroxy compound, preferably in the absence of a glycol, a triol, or any mixture thereof, more preferably in the absence of ethylene glycol, diethylene glycol, propylene glycol, 1.2.6-hexanetriol, glycerine, polyglycerine, or any mixture thereof.

5, Optional Steps

Optionally, the preparation of the complexes can comprise additional steps. Such additional steps can be the addition of a surfactant and/or the addition of one or more laundry adjunct materials. Typically, surfactants are selected from anionic surfactants, cationic surfactants, nonionic surfactants, zwitterionic surfactants, amphoteric surfactants, and mixtures thereof. Typically, laundry adjuncts materials are selected from the group consisting of stabilizers; builders; perfumes; enzymes; chelating agents; suds suppressors; colours; opacifiers; anti-oxidants; bactericides; neutralizing agents; buffering agents; phase regulants, dye-transfer inhibitors, hydrotropes, thickeners and mixtures thereof. Suitable surfactants and laundry adjunct materials are disclosed in WO 99/42 550, GB 2 355 015, WO 02/18 528, WO 99/32 539, WO 01/85 888, WO 02/12 432, EP 0 971 028, and others.

6, Compositions

The compositions of the present invention comprise a complex of cyclodextrin and at least one laundry treatment active wherein the complex is produced according to the steps of the present invention. It is preferred that the laundry treatment active is selected from bleaching agents, brighteners, fabric softening agents, and mixtures thereof.

The cyclodextrin suitable for the compositions of the present invention is the same as described above for the preparation of the complexes. The bleaching agents, brighteners, fabric softening agents, and mixtures thereof suitable for the compositions of the present invention are the same as described above for the preparation of the complexes.

The molar ratio between the cyclodextrin and the laundry treatment active in the compositions of the present invention is the same as described above for the preparation of the complexes.

Unless stated otherwise all percentages herein are weight percent of the final composition.

The complexes of the present invention are typically present in the compositions of the present invention at levels of from 0.01% to 99%, preferably from 0.5% to 35%, more preferably from 1.5% to 20% and most preferably from 2% to 10% by weight of the composition.

The compositions of the present invention comprise more ingredients than just the cyclodextrin/laundry treatment complex. Typically, the further ingredients can be selected from the group of surfactants such as anionic surfactants, cationic surfactants, nonionic surfactants, zwitterionic surfactants, amphoteric surfactants, and mixtures thereof and/or from other materials and such as laundry adjunct materials selected from the group consisting of stabilizers; builders; perfumes; enzymes; chelating agents; suds suppressors; colours; opacifiers; anti-oxidants; bactericides; neutralizing agents; buffering agents; phase regulants, dye-transfer inhibitors, hydrotropes, thickeners and mixtures thereof. More typically, the compositions of the present inventions comprise more than just one, or two or three additional ingredients. Suitable surfactants and laundry adjunct materials are disclosed in WO 99/42 550, GB 2 355 015, WO 02/18 528, WO 99/32 539, WO 01/85 888, WO 02/12 432, EP 0 971 028, and others.

In one preferred embodiment of the present invention, the composition of the present invention is a laundry detergent composition comprising from 0.001% to 99%, preferably of from 0.01% to 30%, more preferably of from 0.1% to 5%, by weight of the composition, of an complex comprising cyclodextrin and at least one laundry treatment active selected from bleaching agents, brighteners, and mixtures thereof.

In another preferred embodiment of the present invention, the composition of the present invention is a fabric softening composition comprising from 0.001% to 99%, preferably of from 1.0% to 80%, more preferably of from 2.0% to 75%, and most preferably of from 8.0% to 25%, by weight of the composition, of a complex comprising cyclodextrin and a fabric softening agent.

7, Form of the Compositions

The compositions of the present invention can be in any suitable form such as a liquid or solid composition. When the composition is a liquid composition, preferably a non-aqueous liquid composition with a low water content of below 15%, preferably below 10%, more preferably between 3% to 8% by weight of the composition, the composition may be encapsulated in a film, preferably in a polymeric film, more preferably in a polymeric and water-soluble film. However, the liquid composition either aqueous or non-aqueous may also be utilized as such. When the composition is in solid form, it may have the form of a powder, or of a granule. Both, the powder or the granule may be compressed to form a shaped body, wherein optionally this body comprises more than one layer. Also the powder, the granule, or even the shaped body may be encapsulated in a film, preferably in a polymeric film, more preferably in a polymeric and water-soluble film.

8, Process for Preparing the Composition

The compositions of the present invention can be prepared in any suitable manner and can, in general, involve any order of mixing or addition as known by the person skilled in the art.

Integration of the Cyclodextrin/Laundry Treatment Active Complex with Other Spray-Dried Ingredients Spray drying all components at the same time in order to obtain a laundry treatment composition comprising all these components is well known by the person skilled in the art. One attractive way to incorporate the cyclodextrin/laundry treatment active complexes of the present invention is to spray-dried them together with the other spray-dried laundry actives. For example the cyclodextrin/laundry treatment active complex is spray-dried together with surfactants, chelants, fillers, polymers, carbonates and other adjunct materials. This mixture being then spray dried and topped with the other dry adds actives such as boosters, perfumes, bleaches, and other adjuncts materials.

Agglomerate the Cyclodextrin/Laundry Treatment Active Complex with a Carrier Prior Dry-Add When appropriate the cyclodextrin/laundry treatment active complexes of the present invention can be combined with carrier material (such as carbonate, surfactant, sulfate, etc) and put through a high shear mixer to produce an agglomerated particle. This particle can then be dry-added into a typical laundry product.

Integration of the Cyclodextrin/Laundry Treatment Active Complex as Dry-Add into Laundry Products Dry adding processes are well known by the person skilled in the art. The cyclodextrin/fabric care active complexes of the present invention are dry-added in any laundry finish product as any other powdery active. The powdery premix obtained for example via any spray-drying process is then to be dry-added into any laundry product using any dry-adding system as known in the art.

Integration of the Cyclodextrin/Laundry Treatment Active Complex in Liquid Compositions This process for preparing the compositions of the present invention is preferably carried out using conventional high-shear mixing means. This ensures proper dispersion or dissolution of all ingredients throughout the final composition.

Liquid compositions, especially liquid detergent compositions in accordance with the invention preferably comprise a stabilizer, especially preferred being trihydroxystearin or hydrogenated castor oil, for example the type commercially available as Thixcin®. When a stabilizer is to be added to the present compositions, it is preferably introduced as a separate stabilizer premix with one or more of the adjuncts, or non-silicone components, of the composition.

9, Method and Use of the Composition

The compositions of the present invention are used for treating substrates. The term "substrate" as used herein means a substrate comprising natural and/or synthetic fibers or fabrics, especially a fabric or garment, having one or more of the laundry treatment benefits described herein as imparted thereto by any of the compositions of the present invention.

A method of treating a substrate comprises the step of contacting the substrate with the composition of the present invention. As used herein, the term "composition" includes laundry detergent compositions, and fabric softening compositions for handwash, machine wash and other purposes including fabric care additive compositions and compositions suitable for use in the soaking and/or pretreatment of fabrics. Furthermore, the term "composition" also includes textile treatment compositions, textile finishing compositions and compositions suitable for use in the soaking and/or pretreatment of fabrics, of textiles and garments.

In the context of this invention, contacting of fabrics with the compositions herein can include direct application of the compositions to fabrics or application of the compositions to fabrics via an aqueous wash, rinse or fabric treatment liquor formed from such a composition. Concentrations of the composition in such aqueous liquor will typically range from 0.01% to 10% by weight of the final aqueous liquor.

Even though fabric treatment compositions are specifically discussed herein, compositions of the present invention for use in treating, cleaning, conditioning, and/or refreshing both natural and synthetic fibers are encompassed by the present invention.

Preferably, the compositions of the present inventions are used for laundering fabrics. More preferably, the compositions dissolve in water to deliver the detergent ingredients to the washing cycle. Typically, the composition is added to the dispensing drawer, or alternatively to the drum, of an automatic washing machine.

Typically, the composition comprises all of the detergent ingredients used in the fabric treatment application during the wash cycle. Although it may be preferred that some detergent ingredients are not comprised and are added to the washing cycle separately. In addition, one or more fabric treatment compositions can be used during the laundering process, such that the composition is used as a pre-treatment, main-treatment, post-treatment or a combination thereof during such a laundering process.

10, Benefits

It has been found that the compositions of the present invention demonstrate very good laundry treatment performance due to very rapid and improved dissolution in the wash liquor once added there into. More particularly, this laundry treatment performance is a fabric cleaning and/or fabric softening performance.

It has been found that starting from a given laundry detergent composition, the separate addition of some cyclodextrin and of some laundry treatment active does not the give desired benefit.

To observe the desired benefit of rapid and improved dissolution in the wash liquor and hence the benefit of optimum performance, it is essential that the cyclodextrin and the laundry treatment active or laundry treatment actives are processed in such way as described herein. Without being bound by theory, it is believed that cyclodextrin and the laundry treatment active(s) when combined according to the present invention, form a complex, preferably an inclusion complex. The complex is believed to be built up in such a way that there exists an interaction between the cyclodextrin and the laundry treatment active or among the cyclodextrin and the laundry treatment actives. The complex is believed to be built up in such a way that last least a part of the laundry treatment active if not the entire molecule is located in the cavity of the cyclodextrin molecule. Having such a complex or having such an inclusion complex, the cyclodextrin serves as a carrier and dissolution aid for the laundry treatment active.

It is believed that the cyclodextrin-laundry treatment active complex is not being built when giving these two component separately to a given laundry detergent composition because the desired benefit cannot be observed.

Similar benefits as in laundry detergent and fabric softening compositions are observed when using the compositions of the present invention in the context of treating and finishing of textiles and garments, e.g. in textile mills and in similar applications.

EXAMPLES

The following non-limiting examples are illustrative of the present invention. Percentages are by weight unless otherwise specified.

Examples I to VII

Preparation of the Cyclodextrin/Laundry Treatment Active Complex

Example I

Cyclodextrin/Bleach Complex

A 250 ml flask equipped with stirrer, overhead condenser, and receiver is connected to a vacuum pump. The stirrer is turned on and the flask is charged with 11,1 grams (0,01 moles) of 2-hydroxypropyl beta-cyclodextrin dissolved in 35 ml of a 1:1 mixture of isopropanol and deionized water. 3,4 grams (0,01 moles) of nonanoyloxybenzenesulfonate (NOBS) dissolved in 25 ml of deionized water are added. The solution is allowed to stir for 10 minutes before the pressure is slowly reduced to 0.01 mbar over a period of eight hours. The solvent system is completely removed from the reaction solution while 14 grams 2-hydroxypropyl beta-cyclodextrin/nonanoyloxybenzenesulphonate complex remained as colourless material in the flask.

Example II

Cyclodextrin/Bleach Activator Complex

A 250 ml flask equipped with stirrer, overhead condenser, and receiver is connected to a vacuum pump. The stirrer is turned on and the flask is charged with 11,1 grams (0,01 moles) of 2-hydroxypropyl beta-cyclodextrin dissolved in 35 ml of a 1:1 mixture of isopropanol and deionized water. 2,3 grams (0,01 moles) of tetraacetylethylenediamine (TAED) dissolved in 25 ml of deionized water are added. The solution is allowed to stir for 10 minutes before the pressure is slowly reduced to 0.01 mbar over a period of eight hours. The solvent system is completely removed from the reaction solution while 13,4 grams 2-hydroxypropyl beta-cyclodextrin/tetraacetylethylenediamine complex remained as colourless material in the flask.

Example III

Cyclodextrin/Brightener Complex

A 250 ml flask equipped with stirrer, overhead condenser, heating mantle, and receiver is connected to a vacuum pump. The stirrer is turned on and the flask is charged with 11,1 grams (0,01 moles) of 2-hydroxypropyl beta-cyclodextrin dissolved in 75 ml of deionized water. 5,6 grams (0,01 moles) disodium 4,4"-bis(2-sulphostyryl)biphenyl dissolved in 50 ml of deionized water are added. The solution is allowed to stir for 10 minutes before the flask is heated to a temperature of 50° C. for a period of 1 hour. After cooling down the reaction solution to room temperature, the pressure is slowly reduced to 0.01 mbar over a period of eight hours. 115 ml of water is removed from the reaction solution while 16,5 grams of the 2-hydroxypropyl beta-cyclodextrin/disodium 4,4"-bis(2-sulphostyryl)biphenyl complex suspended in 5 ml of water remained in the flask.

Example IV

Cyclodextrin/Fabric Softener Complex 1

A 250 ml flask equipped with thermometer, stirrer, heating mantle, overhead condenser, and receiver stirrer is connected to a vacuum pump. The stirrer is turned on and the flask is charged with 11,1 grams (0,01 moles) of 2-hydroxypropyl beta-cyclodextrin dissolved in 35 ml of deionized water. 5,6 grams (0,01 moles) of ditallow-dimethylammonium chloride suspended in 50 ml of deionized water are added. The reaction mixture is allowed to stir for 10 minutes before the flask is heated to a temperature of 50° C. for a period of 1 hour. The pressure is slowly reduced to 0.01 mbar over a period of eight hours. The solvent system is completely removed from the reaction solution while 16 grams 2-hydroxypropyl beta-cyclodextrin/ditallow-dimethylammonium chloride complex remained as colourless material in the flask.

Example V

Cyclodextrin/Fabric Softener Complex 2

A 250 ml flask equipped with thermometer, stirrer, heating mantle, overhead condenser, and receiver stirrer is connected to a vacuum pump. The stirrer is turned on and the flask is charged with 11,1 grams (0,01 moles) of 2-hydroxypropyl beta-cyclodextrin dissolved in 35 ml of deionized water. 7.5 grams of polydimethylsiloxane (Dimethicone (SF1236) ex GE) suspended in 20 ml propylene glycol are added. The reaction mixture is allowed to stir for 30 minutes before the flask is heated to a temperature of 50° C. for a period of 1 hour. The pressure is slowly reduced to 0.001 mbar over a period of eight hours. The solvent system is partially removed from the reaction solution so that 19 grams of product remained as slightly yellowish material in the flask.

Example VI

Cyclodextrin/Brightener Complex 2

A 250 ml flask equipped with stirrer, overhead condenser, heating mantle, and receiver is connected to a vacuum pump. The stirrer is turned on and the flask is charged with 11,1 grams (0,01 moles) of 2-hydroxypropyl beta-cyclodextrin dissolved in 75 ml of deionized water. 4.08 grams (0,01 moles) 1,4-di(2-cyanostyryl)benzene dispersed in 50 ml of deionized water are added. The solution is allowed to stir for 10 minutes before the flask is heated to a temperature of 50° C. for a period of 1 hour. After cooling down the reaction solution to room temperature, the pressure is slowly reduced to 0.01 mbar over a period of eight hours. 120 ml of water is removed from the reaction solution while 15,2 grams of the 2-hydroxypropyl beta-cyclodextrin/1,4-di(-2-cyanostyryl)benzene complex suspended in 5 ml of water remained in the flask.

Example VII

Cyclodextrin/Fabric Softener Ion Pair Complex 3

69.99 grams (0.1 moles) of N,N-dimethyl-N,N-bis-(steroyl oxyethyl) ammonium chloride and 200 ml of ethanol are placed in a 500 ml flask equipped with stirrer, overhead condenser, heating mantle, and receiver. The stirrer is turned on and the flask is charged with 28.2 grams (0.1 moles) of tallow fatty acid. A precipitate forms. Ethanol is distilled of (180 ml at 60° C./0.01 mbar) and is replaced with 200 ml of a 1:1 heptane/hexane mixture. Perlite filter aid (3.0 g) is added and the reaction mixture is filtered at 50° C. to give a solution of the ion pair, which solidifies on standing. The hydrocarbon solvent is removed under reduced pressure to give the N,N-dimethyl-N,N-bis-(steroyl oxyethyl) ammonium tallow fatty acid ion pair-complex.

A 500 ml flask equipped with stirrer, overhead condenser, heating mantle, and receiver is connected to a vacuum pump. The stirrer is turned on and the flask is charged with 11,1 grams (0,01 moles) of 2-hydroxypropyl beta-cyclodextrin dissolved in 75 ml of deionized water. 9.4 grams (0,01 moles) the ion pair described above dispersed in 150 ml of deionized water are added. The solution is allowed to stir for 10 minutes before the flask is heated to a temperature of 50° C. for a period of 3 hours. After cooling down the reaction solution to room temperature, the pressure is slowly reduced to 0.01 mbar over a period of eight hours. 210 ml of water are removed from the reaction solution while 20,5 grams of the 2-hydroxypropyl beta-cyclodextrin/N,N-dimethyl-N,N-bis-(steroyl oxyethyl) ammonium tallow fatty acid ion pair-complex suspended in 15 ml of water remained in the flask.

Examples VIII to XI

Laundry Treatment Compositions Comprising the Cyclodextrin/Laundry Treatment Active Complexes of Examples I to VII Example VIII Granular detergent compositions comprising cyclodextrin-laundry treatment complexes. Both the complexes and the compositions have been prepared according to the present invention:

| | I | II | III | IV | V | VI | VII | VIII | IX |
|---|---|---|---|---|---|---|---|---|---|
| Dodecylbenzene-sulfonic acid, sodium salt | 18 | 18 | 18 | 9 | 7 | 8 | 8 | 18 | 18 |
| Dimethyl hydroxyethyl ammonium chloride | 0.6 | — | 0.6 | 1 | 0.8 | — | — | — | 0.6 |
| C14-15 alkyl sulfate, sodium salt | — | — | — | 5 | 0.3 | — | — | 2 | — |
| C14-15 alkyl sulfate ethoxylated AE7 | 0.3 | 0.9 | — | 4 | 4 | 4 | 4 | 3 | 0.3 |
| C12-15 alkyl sulfate, ethoxylate AE7 | — | — | 0.3 | 0.5 | 0.2 | 1.3 | 1.3 | 2 | — |
| Sodium tripolyphosphate | 22 | 22 | 22 | — | 19 | — | — | 23 | 22 |
| Zeolite A | — | — | — | 21 | — | 15 | 15 | 10 | — |
| Silicate | 6 | 6 | 6 | 0.5 | 3 | — | — | 5 | 6 |
| Sodium citrate | — | — | — | — | — | 5 | 5 | — | — |
| Sodium carbonate | 12 | 12 | 12 | 2 | 19 | 10 | 10 | 10 | 12 |
| Sodium bicarbonate | — | — | — | 9 | — | — | — | — | — |
| Smectite Clay | — | — | — | — | — | 10 | 3 | — | — |
| Percarbonate | — | — | — | — | 13 | 12 | 15 | 10 | — |
| Perborate | 7 | 7 | 7 | — | — | — | — | — | 7 |
| Diethylene triamine pentaacetate | 0.3 | 0.3 | 0.3 | — | — | — | — | 0.2 | 0.3 |
| 1-Hydroxy-ethyidene-1,1-diphosphonic acid | — | — | — | 0.24 | 0.6 | 0.3 | 0.3 | 0.2 | — |
| Sodium ethylene disuccinate | — | — | — | 0.1 | — | 0.3 | 0.3 | 0.2 | — |
| Maleate/acrylate copolymer, Na salt | 1 | 1 | 1 | — | 2 | 4 | 4 | 3 | 1 |
| Soil Release Polymer | 0.1 | 0.1 | 0.1 | — | — | — | — | | 0.1 |
| Carboxy Methyl Cellulose | 0.4 | 0.4 | 0.4 | — | — | — | — | — | 0.4 |
| Sodium sulfate | 22 | 22 | 22 | — | 19 | 3 | 3 | | 22 |
| Mg sulfate | 0.5 | 0.5 | 0.5 | — | — | — | — | — | 0.5 |
| Mannanase | 0.1 | 0.1 | 0.1 | 0.1 | — | — | — | | 0.1 |
| Protease | 0.1 | 0.1 | 0.1 | 0.6 | 0.5 | 0.5 | 0.5 | 0.5 | 0.1 |
| Amylase | 0.1 | 0.1 | 0.1 | 0.5 | 1 | 1 | 1 | 0.5 | 0.1 |
| Lipase | 0.1 | 0.1 | 0.1 | 0.1 | — | — | — | — | 0.1 |
| Cellulase | 0.2 | 0.2 | 0.2 | 0.1 | 0.3 | 0.3 | 0.3 | 0.2 | 0.2 |
| Photoactivated bleach | 0.005 | 0.005 | 0.005 | 0.001 | 0.002 | — | — | — | 0.005 |
| Perfume | 0.3 | 0.3 | 0.3 | 0.4 | 0.4 | 0.6 | 0.6 | 0.5 | 0.3 |
| NOBS complex (Example I) | — | 2 | — | — | 2 | — | — | — | — |
| TAED complex (Example II) | — | — | 3 | — | — | 5 | — | — | — |
| Brightener complex (Example III) | 0.4 | — | — | 0.3 | 0.3 | 0.5 | — | — | — |
| Softener complex 1 (Example IV) | — | — | — | — | — | — | 9 | — | — |
| Softener complex 2 (Example V) | — | — | — | — | — | — | — | 10 | — |
| Brightener complex 2 (Example VI) | — | — | — | — | — | — | — | — | 0.4 |
| Tinopal AMS-GX ® | 0.01 | 0.1 | 0.1 | 0.02 | 0.1 | — | 0.3 | — | 0.01 |
| Miscellaneous and minors | up to 100% | up to 100% | up to 100% | up to 100% | up to 100% | up to 100% | up to 100% | up to 100% | up to 100% |

Example IX

Granular detergent compositions comprising cyclodextrin-laundry treatment complexes. Both the complexes and the compositions have been prepared according to the present invention:

| | I | II | III | VI | V | VI | VII | VIII |
|---|---|---|---|---|---|---|---|---|
| Dodecylbenzene-sulfonic acid, sodium salt | — | — | 19 | 15 | 21 | 6.8 | 8.8 | — |
| C12-C18 alkyl sulfate, sodium salt | 30 | 13 | — | — | — | 16 | 11 | 23 |
| Sodium Laurate | 2.5 | 9 | — | — | — | — | — | — |
| Zeolite A | 2 | 1.3 | — | — | — | 1.3 | 1.3 | 1.3 |
| Sodium carbonate | 20 | 3 | 13 | 8 | 10 | 15 | 15 | 10 |
| Calcium carbonate | 27 | 39 | 35 | — | — | 40 | — | 40 |
| Sodium sulfate | 5 | 5 | 3 | 5 | 3 | — | — | 5 |
| tetrasodium pyrophosphate | 5 | — | — | — | — | 5 | 2.5 | — |
| Sodium tripolyphosphate | 5 | 15 | 10 | — | — | 7 | 8 | 10 |
| Bentonite clay | — | 10 | — | — | 5 | — | — | — |
| Diethylenetriamine-penta-(methylene-phosphonic) acid, 5-Na salt | — | 0.7 | 0.6 | — | 0.6 | 0.7 | 0.7 | 0.7 |
| Carboxy Methyl Cellulose | — | 1 | 1 | 1 | 1 | — | — | 1 |
| Talc | — | — | 10 | 15 | 10 | — | — | — |
| Silicate | — | — | 4 | 5 | 3 | — | — | — |
| Polyvinylpyridine N-oxide | 0.02 | 0.03 | — | 0.01 | — | 0.02 | — | — |
| Maleate/acrylate copolymer, Na salt | 0.4 | 1 | — | — | 0.2 | 0.4 | 0.5 | 0.4 |
| Soil Release Polymer | 0.3 | 0.3 | 0.3 | 0.3 | 0.3 | 0.3 | 0.3 | 0.3 |
| Mannanase | 0.01 | 0.01 | 0.01 | 0.01 | 0.01 | 0.001 | 0.01 | 0.001 |
| Amylase | — | — | 0.01 | — | — | — | 0.002 | — |
| Protease | — | 0.004 | — | 0.003 | 0.003 | — | — | 0.003 |
| Lipase | — | 0.002 | — | 0.002 | — | — | — | — |
| Cellulase | — | 0.0003 | — | — | 0.0003 | 0.0002 | — | — |
| Polyethylene imine | 0.2 | 0.2 | 0.2 | 0.2 | 0.3 | 0.2 | 0.2 | 0.3 |
| Perfume | 1 | 0.5 | 0.3 | 0.2 | 0.4 | — | — | 0.4 |
| Mg sulfate | — | — | 3 | 3 | 3 | — | — | — |
| Brightener complex (Example III) | 0.1 | 0.1 | 0.1 | 0.1 | 0.1 | 0.1 | 0.1 | 0.1 |
| Photobleach (ppm) | — | 15 | 15 | 15 | 15 | — | — | 15 |

Example X

Liquid detergent compositions comprising cyclodextrin-laundry treatment complexes. Both the complexes and the compositions have been prepared according to the present invention:

| | I | II | III | IV | V | VI | VII | IX |
|---|---|---|---|---|---|---|---|---|
| Dodecylbenzene-sulfonic acid, sodium salt | 12 | 9 | — | 4 | — | 2 | 4 | 2 |
| C14-15 alcohol, ethoxylate AE8 | — | 3 | 18 | — | 16 | — | — | — |
| C14-15 alkyl sulfate, ethoxylate AE2.25 | 12 | 3 | — | 16 | — | 10 | 10 | 10 |
| C8-C10 amido propyl dimethylamine | — | 3 | 2 | 2 | 1 | 2 | 2 | 2 |
| C12-14 alcohol, ethoxylate AE7 | 3 | — | — | — | — | — | — | — |

-continued

| | I | II | III | IV | V | VI | VII | IX |
|---|---|---|---|---|---|---|---|---|
| Dodecyldimethylamine N-oxide | — | — | — | 1.7 | 1.7 | 1.7 | 1.7 | 1.7 |
| Coconut fatty acid | — | — | 5.2 | — | 3.1 | — | — | — |
| Topped palm kernel oil | 1.6 | — | 2 | 0.5 | 2 | 0.5 | 0.5 | 0.5 |
| Sodium citrate | 6.5 | 1.2 | 2.5 | 4.4 | 2.5 | 4.4 | 4.4 | 4.4 |
| Calcium formate | 0.1 | 0.06 | 0.1 | — | — | — | — | — |
| Sodium formate | 0.5 | 0.06 | 0.1 | 0.05 | 0.05 | 0.05 | 0.05 | 0.05 |
| Sodium cumene sulfonate | 4 | 1 | 3 | 1.2 | — | 1.2 | 1.2 | 1.2 |
| Borate | 0.6 | — | 3 | 2 | 2.9 | 2 | 2 | 2 |
| Na hydroxide | 5.8 | 2 | 3.5 | 3.7 | 2.7 | 3.7 | 3.7 | 3.7 |
| Ethanol | 1.75 | 1 | 3.6 | 4.2 | 2.9 | 4.2 | 4.2 | 4.2 |
| 1,2 Propanediol | 3.3 | 2. | 8 | 7.9 | 5.3 | 7.9 | 7.9 | 7.9 |
| Monoethanolamine | 3.0 | 1.5 | 1.3 | 2.5 | 0.8 | 2.5 | 2.5 | 2.5 |
| Ethoxylated tetraethylene penatamin | 1.6 | — | 1.3 | 1.2 | 1.2 | 1.2 | 1.2 | 1.2 |
| Mannanase | 0.001 | 0.02 | 0.001 | 0.01 | 0.02 | 0.01 | 0.01 | 0.01 |
| Protease | 0.03 | 0.01 | 0.03 | 0.02 | 0.02 | 0.02 | 0.02 | 0.02 |
| Lipase | — | — | 0.002 | — | — | — | — | — |
| Amylase | — | — | — | 0.002 | — | 0.002 | 0.002 | 0.002 |
| Cellulase | — | — | 0.0002 | 0.0005 | 0.0001 | 0.0005 | 0.0005 | 0.0005 |
| Sodium cumene sulphonate | 0.2 | — | 0.1 | — | — | — | — | — |
| Ethylene triamine penta (methyl phosphonic) acid | — | — | 0.3 | — | — | — | — | — |
| Polyethyleneimmine 600 | 0.4 | 0.4 | 0.4 | 0.4 | 0.4 | 0.4 | 0.4 | 0.4 |
| Sodium palmitate | — | — | 3 | — | 2 | — | — | — |
| Silicone antifoam | 0.04 | 0.02 | 0.1 | 0.1 | 0.1 | 0.1 | — | 0.1 |
| Brightener complex (Example III) | 0.2 | 0.07 | 0.1 | 0.1 | 0.1 | — | 3.9 | — |
| Softener complex 1 (Example IV) | — | — | — | — | — | 9 | — | — |
| Softener complex 3 (Example VII) | — | — | — | — | — | — | — | 9 |
| N,N-Pthaloylamino-peroxycaproic acid | — | — | — | — | — | — | 3 | — |
| Miscellaneous and minors | up to 100% | up to 100% | up to 100% | up to 100% | up to 100% | up to 100% | up to 100% | up to 100% |

Example XI

Liquid detergent compositions and rinse-added fabric softening compositions comprising cyclodextrin-laundry treatment complexes. Both the complexes and the compositions have been prepared according to the present invention:

| | I | II | III |
|---|---|---|---|
| Dodecylbenzene-sulfonic acid, sodium salt | — | 5 | 1 |
| Polyethylene imine | 0.5 | 1 | — |
| Sodium tripolyphosphate | 29.5 | — | 20 |
| Zeolite A | — | 30 | — |
| $NaBO_3 \cdot H_2O$ | 20 | 15 | — |
| Perfume | — | — | 2 |
| Protease | — | 0.3 | — |
| Amylase | — | 0.06 | — |
| TAED/TAED complex (Example II) | 2/6 | —/10 | — |
| Softener complex 1 (Example IV) | — | — | 70 |
| Minors, water and miscellaneous | Up to 100% | Up to 100% | Up to 100% |

The laundry treatment compositions as disclosed in Examples VIII to XI all provide improved dissolution profile when added to water, either in cold or hot water, either under hard or soft water conditions. The laundry treatment compositions as disclosed in Examples VIII to XI all provide excellent fabric cleaning and/or fabric softening performance when added to the drum of an automatic washing machine, to the drum of a non-automatic washing machine, and/or when used by hand wash, wherein fabrics are there and thereinafter laundered in conventional manner.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

The invention claimed is:

1. A composition, the composition comprising:

(A) an inclusion complex of cyclodextrin and at least one laundry treatment active comprising a fabric softening agent, wherein the complex is prepared by the steps of:

a. combining the cyclodextrin and the at least one laundry treatment active wherein the cyclodextrin and the at least one laundry treatment active are dissolved, dispersed, suspended, or emulsified in at least one solvent; and b. removing at least partially the solvent; and (B) at least one laundry adjunct material comprising a builder.

2. A composition according to claim 1 wherein in step (b) the solvent is completely removed.

3. A composition according to claim 1 wherein the cyclodextrin is selected from the group consisting of unsubstituted and substituted cyclodextrins containing from six to twelve glucose units, derivatives of unsubstituted and substituted cyclodextrins, and mixtures thereof.

4. A composition according to claim 1 wherein the molar ratio of the cyclodextrin to the at least one laundry treatment active is between about 100:1 to about 1:100.

5. A composition according to claim 4 wherein the molar ratio of the cyclodextrin to the at least one laundry treatment active is between about 2:1 to about 1:2.

6. A composition according to claim 1 wherein the preparation of the complex further comprises the step of:

(c) adding at least one laundry adjunct material selected from the group consisting of surfactants; stabilizers; builders; perfumes; enzymes; chelating agents; suds suppressors; and mixtures thereof.

7. A composition according to claim 6 wherein the surfactant is selected from the group consisting of anionic surfactants, cationic surfactants, nonionic surfactants, zwitterionic surfactants, amphoteric surfactants, and mixtures thereof.

8. A composition according to claim 1 wherein the preparation of the complex is carried out in the absence of any additional polyhydroxy compound.

9. A composition according to claim 8 wherein the preparation of the complex is carried out in the absence of ethylene glycol, diethylene glycol, propylene glycol, 1.2.6-hexanetriol, glycerine, polyglycerine, or any mixture thereof.

10. A composition according to claim 1 wherein the composition is in the form of a liquid composition, a granular composition, or a granular composition compressed to form a shaped body.

11. A granular composition according to claim 10 wherein the shaped body comprises more than one layer.

12. A liquid composition according to claim 10 wherein the composition is surrounded by a film.

13. A liquid composition according to claim 12 wherein the film is a water-soluble film.

14. A composition according to claim 1 wherein the composition is a laundry detergent composition comprising from about 0.001% to about 99% by weight of the composition, of a complex.

15. A composition according to claim 14 wherein the composition is a laundry detergent composition comprising from about 0.1% to about 5% by weight of the composition, of a complex.

16. The composition according to claim 1 wherein the composition is a fabric softening composition comprising from about 0.001% to about 99%, by weight of the composition, of a complex comprising cyclodextrin and a fabric softening agent.

17. The composition according to claim 16 wherein the composition is a fabric softening composition comprising from about 2.0% to about 75%, by weight of the composition, of a complex comprising cyclodextrin and a fabric softening agent.

18. The composition according to claim 1, wherein said at least one laundry treatment active further comprises a bleaching agent; a brighter; and combinations thereof.

19. The composition according to claim 1 wherein the composition is a fabric softening agent comprising from about 0.001% to about 99%, by weight of the composition, of a complex comprising cyclodextrin and a fabric softening agent.

20. The composition of claim 1, wherein said fabric softening agent comprises a quaternary-ammonium fabric softening active and at least one source of acid comprising a $C_{12}$-$C_{22}$ fatty acid, a mono-alkyl ester of a $C_{12}$-$C_{22}$ alkyl sulphuric acid, a $C_{11}$-$C_{13}$ alkyl benzene sulphonic acid, an anionic derivative thereof, a salt thereof, and combinations thereof.

21. A process for preparing a composition, the process comprises the steps of:

(A) preparing an inclusion complex of cyclodextrin and at least one laundry treatment active comprising a fabric softening agent by:

(a) combining the cyclodextrin and the at least one laundry treatment active wherein the cyclodextrin and the at least one laundry treatment active are dissolved, dispersed, suspended, or emulsified in at least one solvent; and (b) removing at least partially the solvent;

(B) combining the complex of step (A) with at least one laundry adjunct material comprising one or more builders.

* * * * *

UNITED STATES PATENT AND TRADEMARK OFFICE

CERTIFICATE OF CORRECTION

PATENT NO. : 7,320,955 B2
APPLICATION NO. : 11/348152
DATED : January 22, 2008
INVENTOR(S) : Yates et al.

It is certified that error appears in the above-identified patent and that said Letters Patent is hereby corrected as shown below:

Column 1
Lines 8-9, delete "abandonded" and insert -- abandoned --.

Column 17
Lines 16-17, delete "C1-C1-C30 dialkylamino" and insert -- C1-C30 dialkylamino --.

Signed and Sealed this

Seventeenth Day of June, 2008

JON W. DUDAS
*Director of the United States Patent and Trademark Office*